US010656557B2

(12) United States Patent
Mizuno et al.

(10) Patent No.: US 10,656,557 B2
(45) Date of Patent: May 19, 2020

(54) DEVELOPING CARTRIDGE INCLUDING FIRST GEAR, SECOND GEAR ENGAGEABLE WITH FIRST GEAR, AND LINK

(71) Applicant: BROTHER KOGYO KABUSHIKI KAISHA, Nagoya-shi, Aichi-ken (JP)

(72) Inventors: Tomoyuki Mizuno, Nagoya (JP); Tomonori Watanabe, Ichinomiya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/258,959

(22) Filed: Jan. 28, 2019

(65) Prior Publication Data

US 2019/0258190 A1 Aug. 22, 2019

(30) Foreign Application Priority Data

Feb. 22, 2018 (JP) ..... 2018-029400

(51) Int. Cl.
*G03G 15/08* (2006.01)
*G03G 21/16* (2006.01)
*G03G 21/18* (2006.01)

(52) U.S. Cl.
CPC ..... *G03G 15/0865* (2013.01); *G03G 15/0896* (2013.01); *G03G 21/1647* (2013.01); *G03G 21/1896* (2013.01); *G03G 2215/0665* (2013.01); *G03G 2215/0695* (2013.01)

(58) Field of Classification Search
None
See application file for complete search history.

(56) References Cited

U.S. PATENT DOCUMENTS

2007/0122165 A1* 5/2007 Igarashi ..... G03G 15/0822 399/12
2011/0236062 A1 9/2011 Takagi
2014/0086613 A1* 3/2014 Itabashi ..... G03G 15/0863 399/90

FOREIGN PATENT DOCUMENTS

EP 3 270 227 A1 1/2018
JP 2011-203362 A 10/2011

OTHER PUBLICATIONS

Extended European Search Report issued in related European Patent Application No. 19153922.0, dated Jun. 26, 2019.

* cited by examiner

*Primary Examiner* — Victor Verbitsky
(74) *Attorney, Agent, or Firm* — Merchant & Gould P.C.

(57) ABSTRACT

A developing cartridge includes: a casing; a first gear; a second gear; a cover; a link; and an urging member engaging with the second gear and the link. The second gear is rotatable from a first position to a second position in accordance with the first gear when the second gear engages with the first gear. The link is movable together with rotation of the second gear and pivotally movable relative to the second gear. The link has: a first state where a distal end portion of the link contacts the cover; and a second state where the link pivotally moves relative to the second gear. The first state is provided due to resilient deformation of the urging member in the first position of the second gear. The second state is provided due to a restoring force of the urging member in the second position of the second gear.

21 Claims, 16 Drawing Sheets

DEVELOPING CARTRIDGE INCLUDING FIRST GEAR, SECOND GEAR ENGAGEABLE WITH FIRST GEAR, AND LINK

CROSS REFERENCE TO RELATED APPLICATION

This application claims priority from Japanese Patent Application No. 2018-029400 filed Feb. 22, 2018. The entire content of the priority application is incorporated herein by reference.

TECHNICAL FIELD

The present disclosure relates to a developing cartridge used for an image forming apparatus.

BACKGROUND

There have been known image forming apparatuses including developing cartridges. One of such image forming apparatuses is capable of determining whether or not the developing cartridge is attached or identifying the specification of the developing cartridge. For example, Japanese Patent Application Publication No. 2011-203362 discloses a developing cartridge including a detection gear and protrusions movable together with rotation of the detection gear. In this configuration, an image forming apparatus detects the protrusions by means of a sensor to determine whether the developing cartridge is attached.

SUMMARY

In a case where the image forming apparatus is configured to identify the specification of the developing cartridge by detecting the protrusions thereof, the arrangement patterns of the protrusions are made different for each of a plurality of specifications. This enables the image forming apparatus to identify a developing cartridge having a specific specification from among the plurality of specifications. In recent years, there is a demand for new gear structures of the developing cartridges in response to diversification of the specifications of the developing cartridges.

In view of the foregoing, it is an object of the present disclosure to provide a developing cartridge having a new gear structure that can be used for identifying the specification of the developing cartridge.

In order to attain the above and other objects, the disclosure provides a developing cartridge including: a casing; a first gear; a second gear; a cover; a link; and an urging member. The casing is configured to accommodate developing agent therein. The casing has an outer surface. The first gear is positioned at the outer surface. The first gear is rotatable about a first axis extending in a first direction. The second gear is positioned at the outer surface. The second gear is rotatable about a second axis extending in the first direction. The second gear is rotatable from a first position to a second position in accordance with rotation of the first gear in a state where the second gear engages with the first gear. The cover is positioned at the outer surface. The link is movable together with rotation of the second gear. The link is pivotally movable relative to the second gear. The link includes a distal end portion. The link has: a first state in which the distal end portion is in contact with the cover; and a second state in which the distal end portion separates from the cover and the link pivotally moves relative to the second gear. The link is in the first state in a state where the second gear is at the first position. The link is in the second state in a state where the second gear is at the second position. The urging member engages with both the second gear and the link. The urging member provides the first state of the link due to resilient deformation of the urging member. The urging member provides the second state of the link by pivotally moving the link relative to the second gear due to a restoring force of the urging member.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Hereinafter, a laser printer 1 including a developing cartridge 10 according to one embodiment of the present disclosure will be descried in detail with reference to the accompanying drawings.

Figure 1:
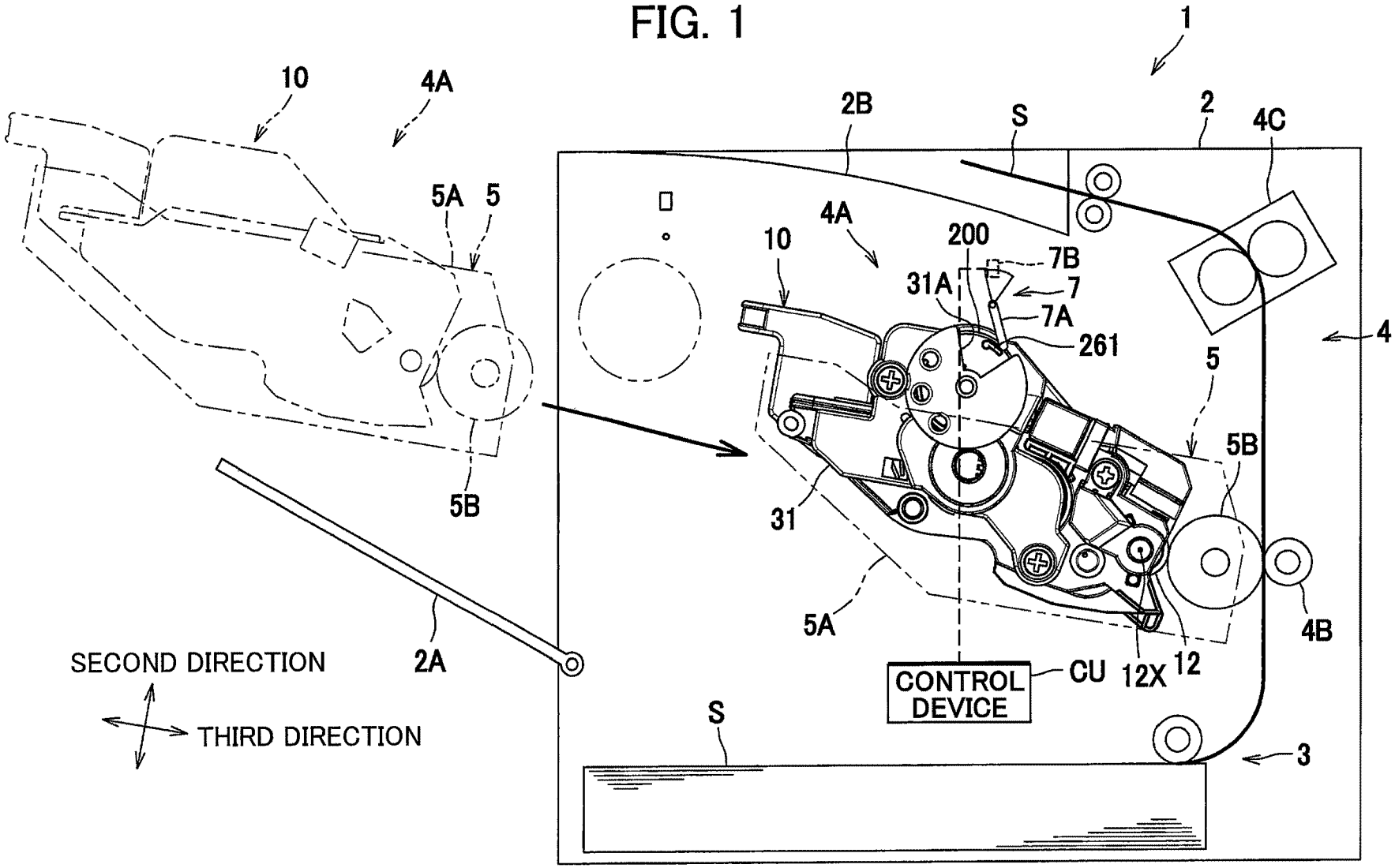
FIG. 1 is a diagram illustrating an overall configuration of a laser printer including a developing cartridge according to one embodiment of the present disclosure.

As illustrated in FIG. 1, the laser printer 1 as an example of an image forming apparatus mainly includes a main body housing 2, a sheet supply portion 3, an image forming portion 4, and a control device CU.

The main body housing 2 includes a front cover 2A, and a sheet discharge tray 2B that is positioned at the upper portion of the main body housing 2. The main body housing 2 accommodates the sheet supply portion 3 and the image forming portion 4 therein. In a state where the front cover 2A is opened, the developing cartridge 10 is detachably attached to the main body housing 2.

The sheet supply portion 3 accommodates sheets of paper S therein. The sheet supply portion 3 supplies the sheets S one by one to the image forming portion 4.

The image forming portion 4 includes a process cartridge 4A, an exposure unit (not illustrated), a transfer roller 4B, and a fixing device 4C.

The process cartridge 4A includes a photosensitive cartridge 5, and the developing cartridge 10. The developing cartridge 10 is attachable to and detachable from the photosensitive cartridge 5. In a state where the developing cartridge 10 is attached to the photosensitive cartridge 5, the developing cartridge 10 is attached to and detached from the main body housing 2 as the process cartridge 4A. The photosensitive cartridge 5 includes a frame 5A and a photosensitive drum 5B rotatably supported by the frame 5A.

Figure 2:
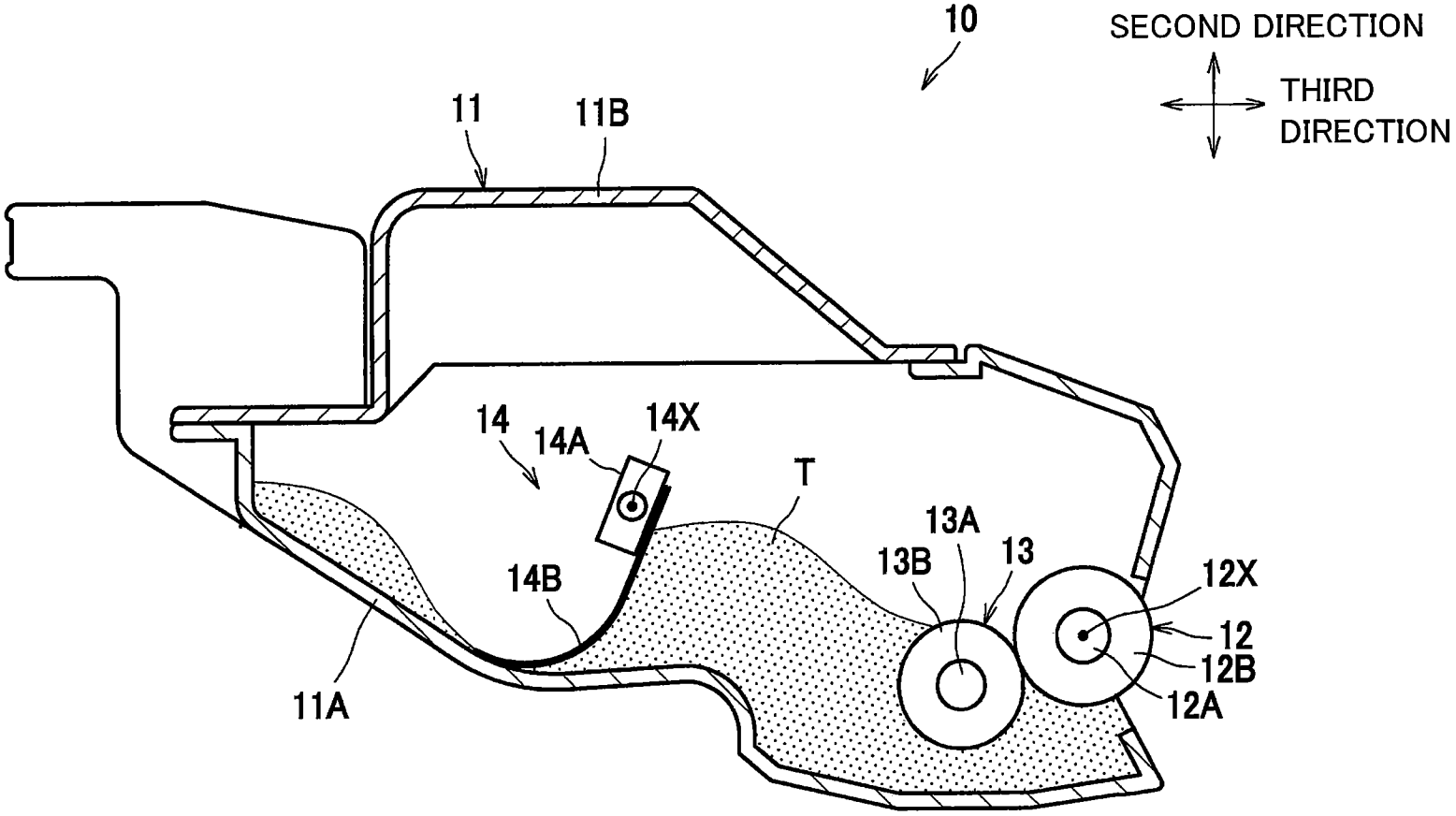
FIG. 2 is a cross-sectional view illustrating a configuration of a casing of the developing cartridge according to the embodiment.

As illustrated in FIG. 2, the developing cartridge 10 includes a casing 11, a developing roller 12, a supply roller 13, and an agitator 14.

The casing 11 includes a container 11A and a lid 11B. The container 11A of the casing 11 is configured to accommodate toner T therein. The toner T is an example of developing agent.

The developing roller 12 includes a developing roller shaft 12A extending in a first direction, and a roller portion 12B. The first direction is parallel to an axial direction of a second agitator gear 100 (described later). Hereinafter, the first direction is also simply referred to as the axial direction. The roller portion 12B covers an outer circumferential surface of the developing roller shaft 12A. The roller portion 12B is made of, for example, electrically conductive rubber.

The developing roller 12 is rotatable about the developing roller shaft 12A. In other words, the developing roller 12 is rotatable about a fourth axis 12X extending in the first direction. The developing roller 12 is supported by the casing 11 so as to be rotatable about the developing roller shaft 12A. That is, the roller portion 12B of the developing roller 12 is rotatable together with the developing roller shaft 12A. A developing bias is applied to the developing roller 12 by the control device CU.

The container 11A and the lid 11B of the casing 11 face each other in a second direction. The second direction crosses the first direction. Preferably, the second direction is orthogonal to the first direction. The developing roller 12 is positioned at one end portion of the casing 11 in a third direction. The third direction crosses both the first direction and the second direction. Preferably, the third direction is orthogonal to both the first direction and the second direction.

The supply roller 13 includes a supply roller shaft 13A extending in the first direction, and a roller portion 13B. The roller portion 13B covers an outer circumferential surface of the supply roller shaft 13A. The roller portion 13B is made of, for example, sponge. The supply roller 13 is rotatable about the supply roller shaft 13A. That is, the roller portion 13B of the supply roller 13 is rotatable together with the supply roller shaft 13A.

The agitator 14 includes an agitator shaft 14A as an example of a shaft, and a flexible sheet 14B. The agitator shaft 14A is rotatable about a first axis 14X extending in the first direction. The agitator shaft 14A is supported by the casing 11 so as to be rotatable about the first axis 14X. The agitator shaft 14A is rotatable in accordance with rotation of a coupling 22 (described later). The flexible sheet 14B has a base end fixed to the agitator shaft 14A and a leading end configured to contact an inner surface of the casing 11. The agitator 14 is configured to agitate the toner T by rotating the flexible sheet 14B.

As illustrated in FIG. 1, the transfer roller 4B faces the photosensitive drum 5B. The transfer roller 4B conveys the sheet S while nipping the sheet S between the transfer roller 4B and the photosensitive drum 5B.

The photosensitive drum 5B is charged by a charger (not illustrated) and is exposed to light by the exposure unit, whereby an electrostatic latent image is formed on the photosensitive drum 5B. The developing cartridge 10 supplies the toner T to the electrostatic latent image to form a toner image on the photosensitive drum 5B. The toner image formed on the photosensitive drum 5B is transferred onto the sheet S supplied from the sheet supply portion 3 while the sheet S passes through between the photosensitive drum 5B and the transfer roller 4B.

The fixing device 4C thermally fixes the toner image transferred onto the sheet S to the sheet S. The sheet S to which the toner image has been thermally fixed is discharged onto the sheet discharge tray 2B outside the main body housing 2.

The control device CU is a device which controls the entire operation of the laser printer 1.

The laser printer 1 includes a sensor 7. The sensor 7 is configured to detect whether or not the developing cartridge 10 is a new cartridge, or to identify the specification of the developing cartridge 10. The sensor 7 includes a lever 7A pivotably supported by the main body housing 2, and an optical sensor 7B.

The lever 7A is positioned at a position where the lever 7A can contact, for example, a protrusion(s) movable together with rotation a detection gear 200 (described later). The optical sensor 7B is electrically connected to the control device CU and configured to output a detection signal to the control device CU. The control device CU is configured to identify the specification and the like of the developing cartridge 10 on the basis of the detection signal received from the optical sensor 7B. The optical sensor 7B detects displacement of the lever 7A and transmits the detection signal to the control device CU. More specifically, for example, a sensor unit including a light-emitting portion and a light-receiving portion is employed as the optical sensor 7B. The details will be described later.

Figure 3:
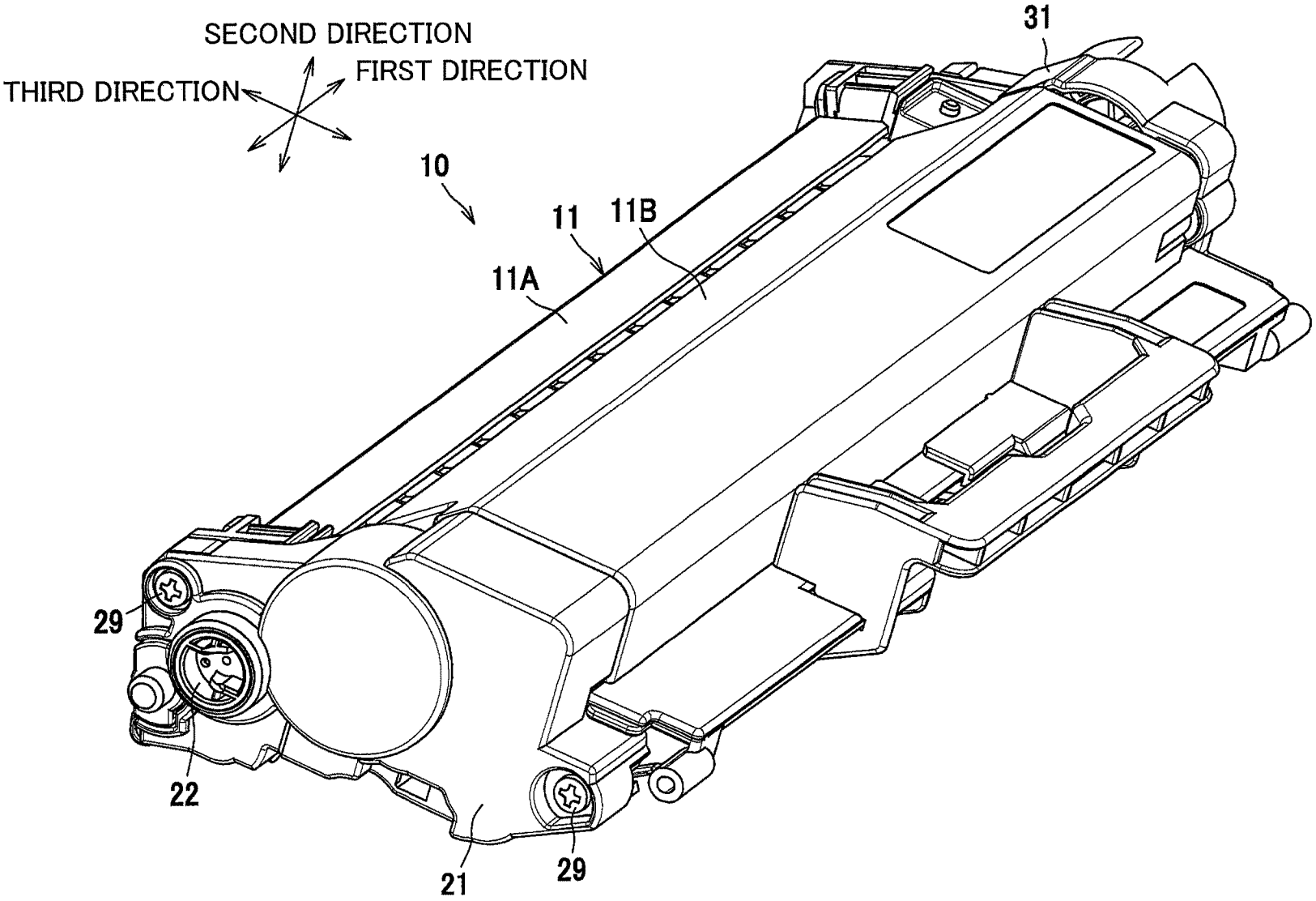
FIG. 3 is a perspective view illustrating one side in a first direction of the developing cartridge according to the embodiment.
Figure 4:
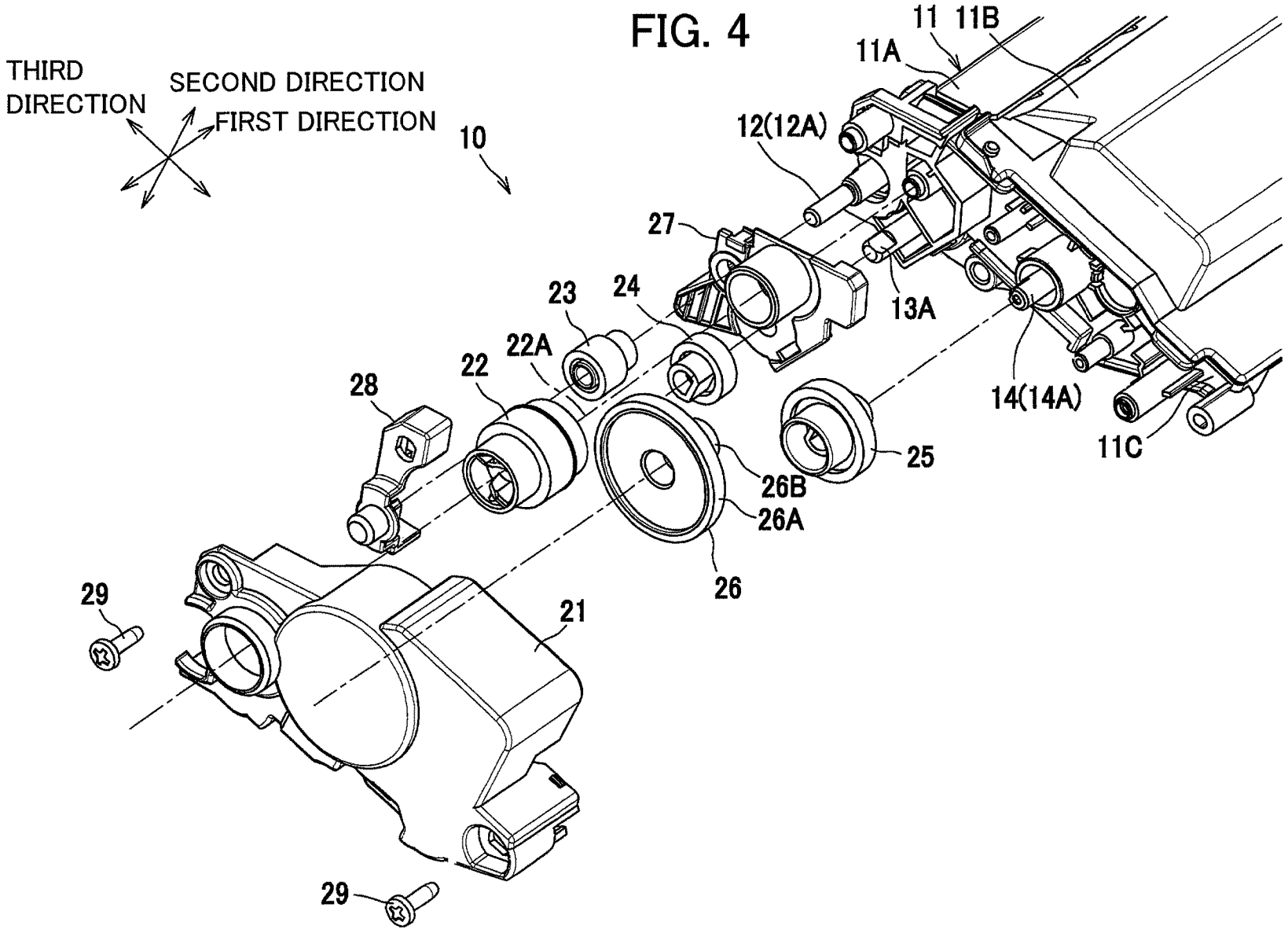
FIG. 4 is an exploded perspective view of parts positioned at one side in the first direction of the casing of the developing cartridge according to the embodiment.

Next, the detailed configuration of the developing cartridge 10 will be described. As illustrated in FIGS. 3 and 4, the developing cartridge 10 further includes a first gear cover 21, the coupling 22, a developing gear 23, a supply gear 24, a first agitator gear 25, an idle gear 26, a first bearing 27, and a cap 28. The first gear cover 21, the coupling 22, the developing gear 23, the supply gear 24, the first agitator gear 25, the idle gear 26, the first bearing 27, and the cap 28 are positioned at one side of the casing 11 in the first direction.

The first gear cover 21 includes a shaft (not illustrated) and supports the idle gear 26 by the shaft. The first gear cover 21 covers at least one of the gears positioned at the one side of the casing 11 in the first direction. The first gear cover 21 is fixed to an outer surface 11C with screws 29. The outer surface 11C is an outer surface positioned at the one side of the casing 11 in the first direction.

Note that, in the present specification, "gear" is not limited to a member which has gear teeth and transmits a rotational force through the gear teeth, but includes a member which transmits a rotational force by a friction transmission. Further, in the member which transmits the rotational force by the friction transmission, a circle along a friction transmitting surface (i.e., an outer circumferential surface which transmits the rotational force through friction) is defined as an addendum circle.

The coupling 22 is rotatable about a third axis 22A extending in the first direction. The coupling 22 is positioned at the one side of the casing 11 in the first direction. That is, the coupling 22 is positioned at the outer surface 11C. The coupling 22 is rotatable by receiving drive force. More specifically, the coupling 22 can receive drive force from the laser printer 1. The laser printer 1 includes a drive member (not illustrated), and the coupling 22 is rotatable by engaging with the drive member.

The coupling 22 has a recessed portion which is recessed in the first direction. The recessed portion is configured to receive the drive member and to engage with the drive member. More specifically, engagement of the recessed portion with the drive member enables the recessed portion to receive drive force from the drive member of the laser printer 1.

The developing gear 23 is coupled to the developing roller shaft 12A and is rotatable in accordance with the rotation of the coupling 22. The developing gear 23 is positioned at the one side of the casing 11 in the first direction. That is, the developing gear 23 is positioned at the outer surface 11C.

The supply gear 24 is coupled to the supply roller shaft 13A and is rotatable in accordance with the rotation of the coupling 22. The supply gear 24 is positioned at the one side of the casing 11 in the first direction. That is, the supply gear 24 is positioned at the outer surface 11C.

The first agitator gear 25 is positioned at the one side of the casing 11 in the first direction. That is, the first agitator gear 25 is positioned at the outer surface 11C. The first agitator gear 25 is coupled to the agitator shaft 14A of the agitator 14 and is rotatable together with the agitator 14 in accordance with the rotation of the coupling 22.

The idle gear 26 is positioned at the one side of the casing 11 in the first direction. That is, the idle gear 26 is positioned at the outer surface 11C. The idle gear 26 includes a large diameter portion 26A in engagement with gear teeth of the coupling 22, and a small diameter portion 26B in engagement with gear teeth of the first agitator gear 25. The idle gear 26 is rotatably supported by the shaft (not illustrated) of the first gear cover 21. The idle gear 26 decelerates the rotation of the coupling 22 and transmits the decelerated rotation to the first agitator gear 25. Incidentally, the large diameter portion 26A is positioned farther away from the casing 11 in the first direction than the small diameter portion 26B is from the casing 11.

The first bearing 27 rotatably supports the coupling 22, the developing gear 23, and the supply gear 24. The first bearing 27 is fixed to the one side of the casing 11 in the first direction.

The cap 28 covers one end portion of the developing roller shaft 12A in the first direction. The first gear cover 21 and the cap 28 may be made of mutually different resins.

Figure 5:
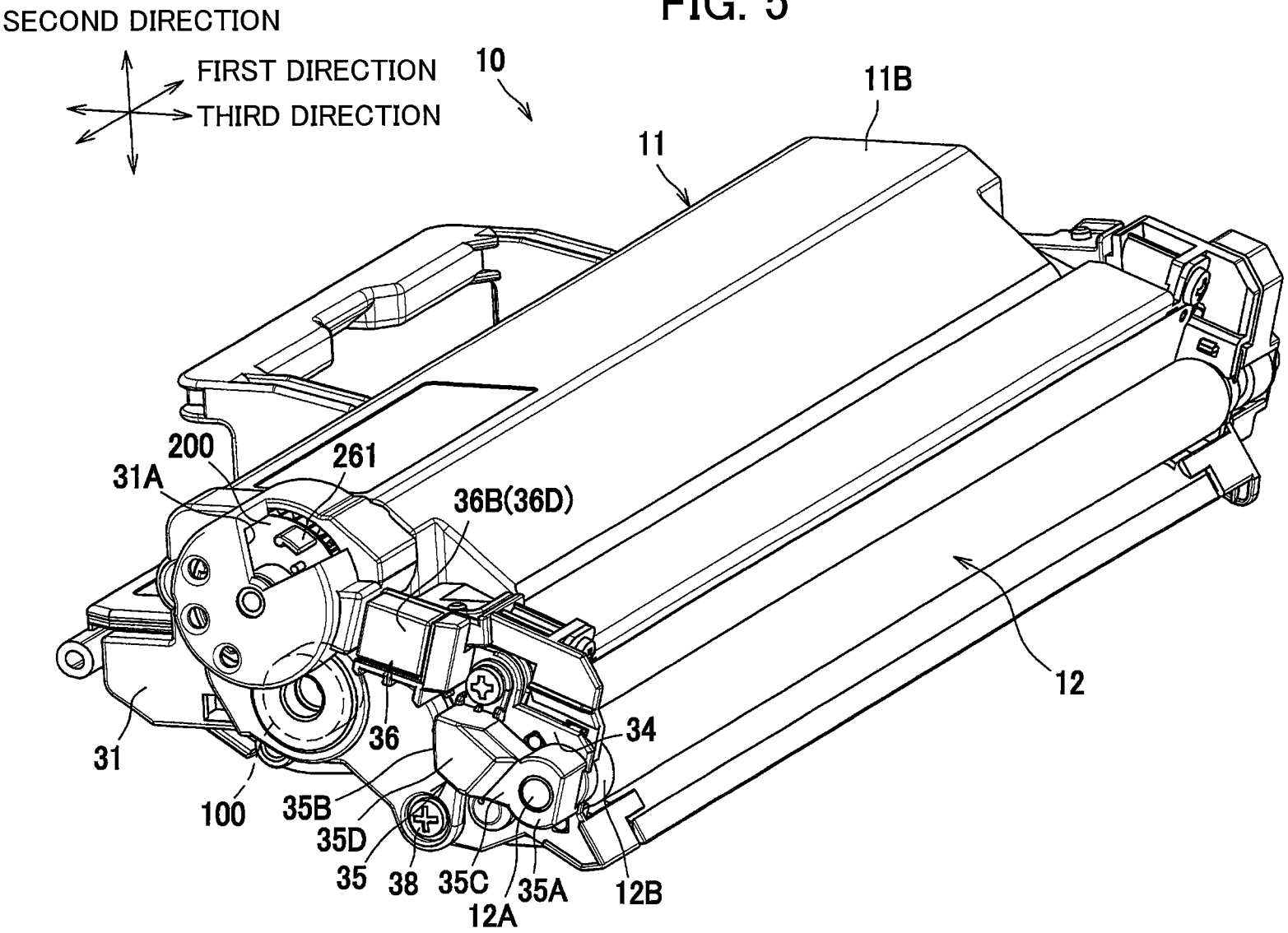
FIG. 5 is a perspective view illustrating another side in the first direction of the developing cartridge according to the embodiment.
Figure 6:
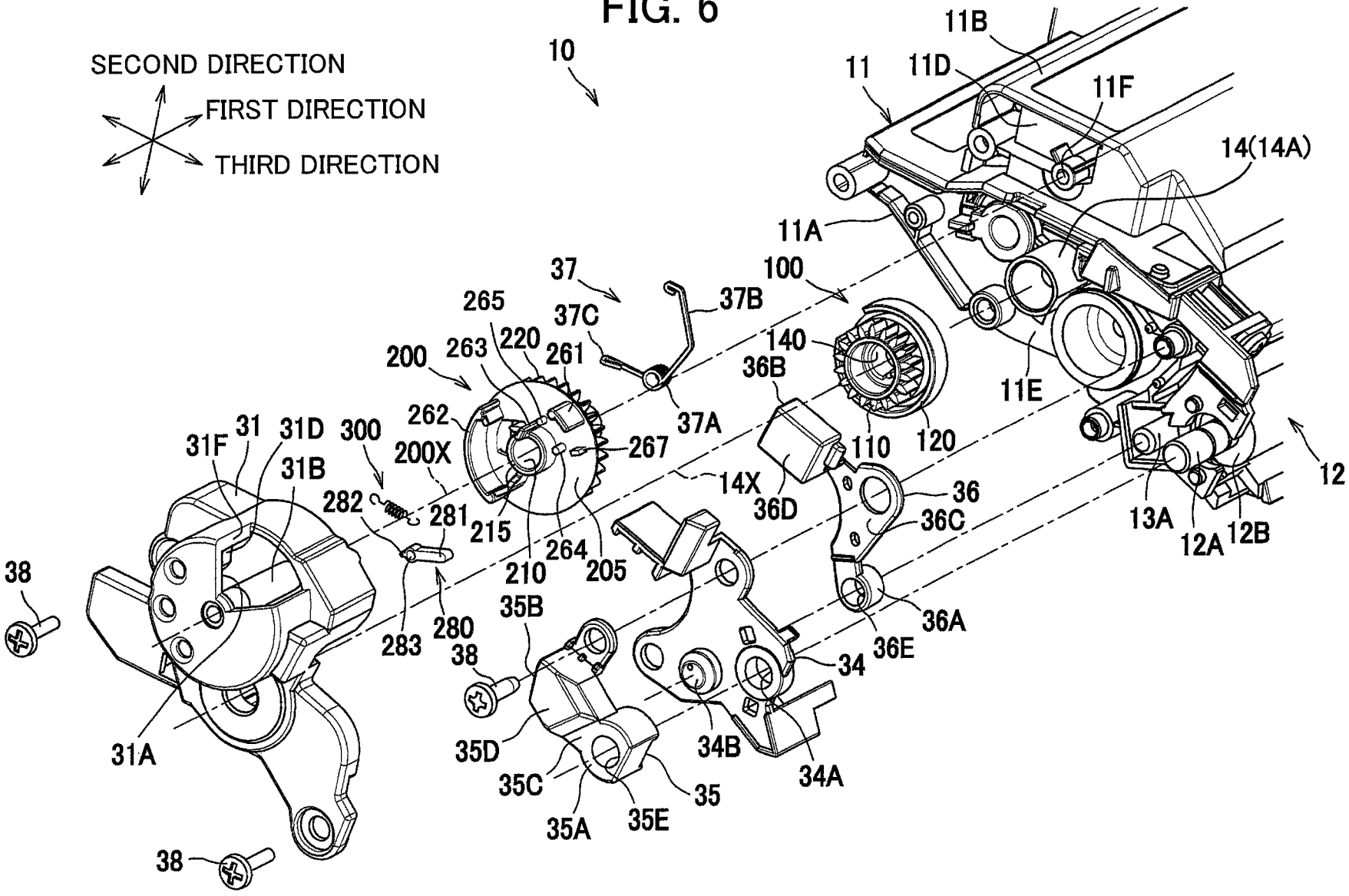
FIG. 6 is an exploded perspective view of parts positioned at another side in the first direction of the casing of the developing cartridge according to the embodiment.

As illustrated in FIGS. 5 and 6, the developing cartridge 10 includes a second gear cover 31 as an example of a cover, the second agitator gear 100 as an example of a first gear, the detection gear 200 as an example of a second gear, a second bearing 34, a developing electrode 35, and a supply electrode 36. The second gear cover 31, the second agitator gear 100, the detection gear 200, the second bearing 34, the developing electrode 35, and the supply electrode 36 are positioned at another side of the casing 11 in the first direction.

The second gear cover 31 covers at least a portion of the detection gear 200. The second gear cover 31 is positioned at an outer surface 11E, which is defined at another side in the first direction of the container 11A of the casing 11. The second gear cover 31 has an opening 31A. A portion of the detection gear 200 is exposed to an outside of developing cartridge 10 through the opening 31A. Further, the second gear cover 31 includes a shaft 31B extending in the first direction.

Figure 7:
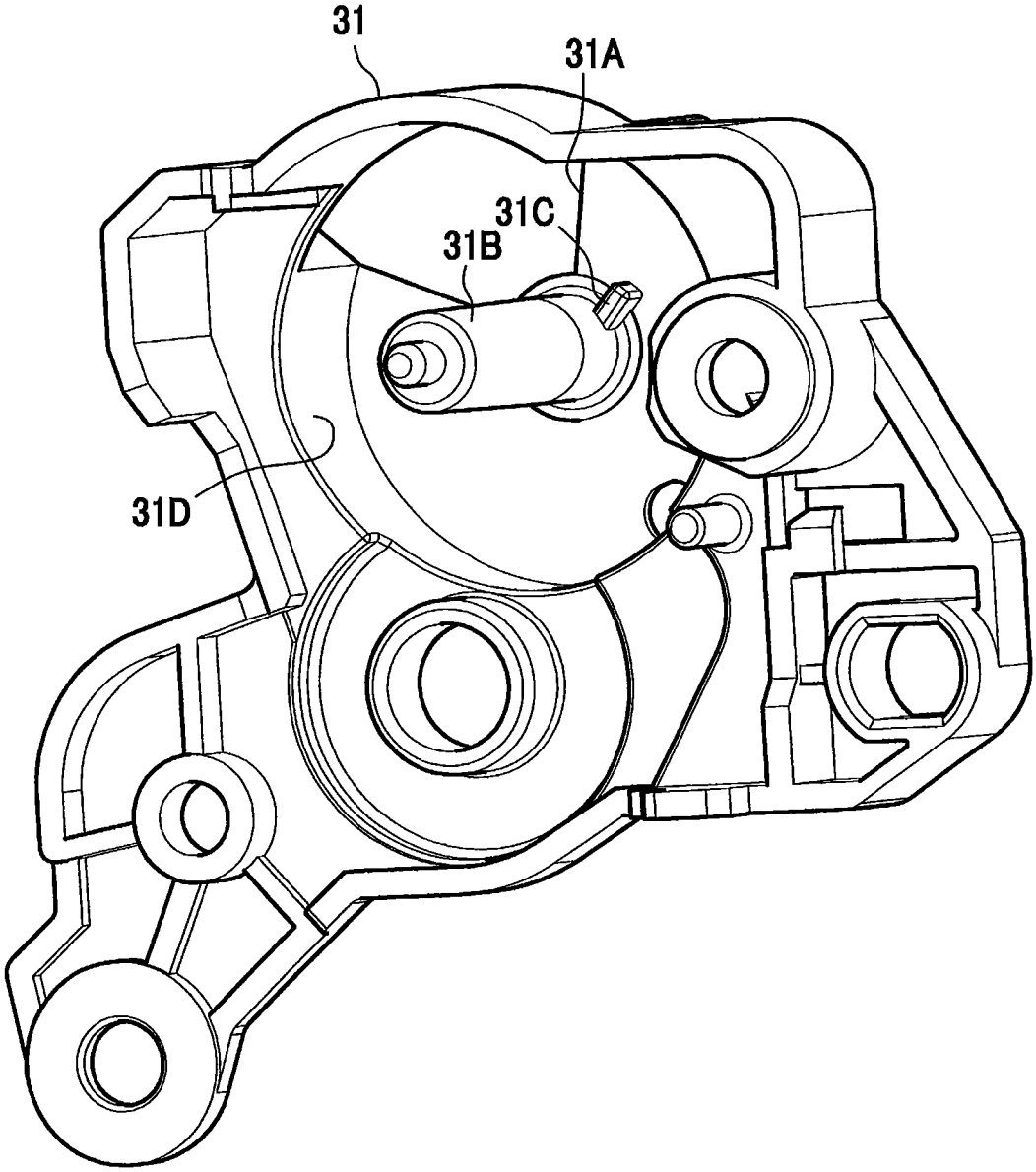
FIG. 7 is a perspective view of a second gear cover of the developing cartridge according to the embodiment as viewed from an inner side thereof.

As illustrated in FIG. 7, the second gear cover 31 further includes a protrusion 31C protruding radially outward from the shaft 31B, and has a contact surface 31D. The contact surface 31D is configured to contact a leading end of a link 280 (described later) provided at the detection gear 200. The contact surface 31D extends along a portion of a circumferential periphery of the detection gear 200 and provided at a position substantially the same as the opening 31A in the axial direction.

As illustrated in FIG. 6, the second gear cover 31 also includes a second stopper 31F (see also FIG. 10B) extending from the contact surface 31D toward a second axis 200X of the detection gear 200. The second stopper 31F is positioned at a downstream end of the contact surface 31D in a rotational direction of the detection gear 200. The second stopper 31F is configured so that a distal end portion 281 of the link 280 (described later) can contact the second stopper 31F. The second gear cover 31 further includes a torsion spring 37 which will be described in detail later.

The second agitator gear 100 is positioned at the other side of the casing 11 in the first direction. That is, the second agitator gear 100 is positioned at the outer surface 11E which is defined at the other side of the container 11A of the casing 11 in the first direction. The second agitator gear 100 has an attaching hole 140. By engaging the attaching hole 140 with the agitator shaft 14A of the agitator 14, the second agitator gear 100 is coupled to the agitator shaft 14A. With this configuration, the second agitator gear 100 is rotatable about the first axis 14X extending in the axial direction together with the agitator shaft 14A of the agitator 14. That is, the second agitator gear 100 is rotatably supported by the casing 11.

Figure 8A:
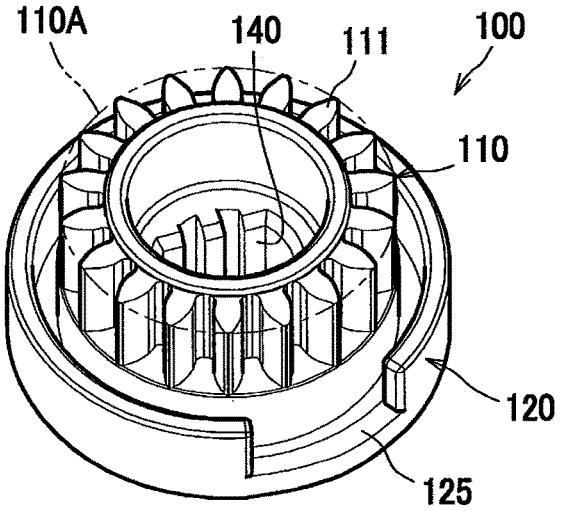
FIG. 8A is an enlarged perspective view of a second agitator gear of the developing cartridge according to the embodiment.
Figure 8B:
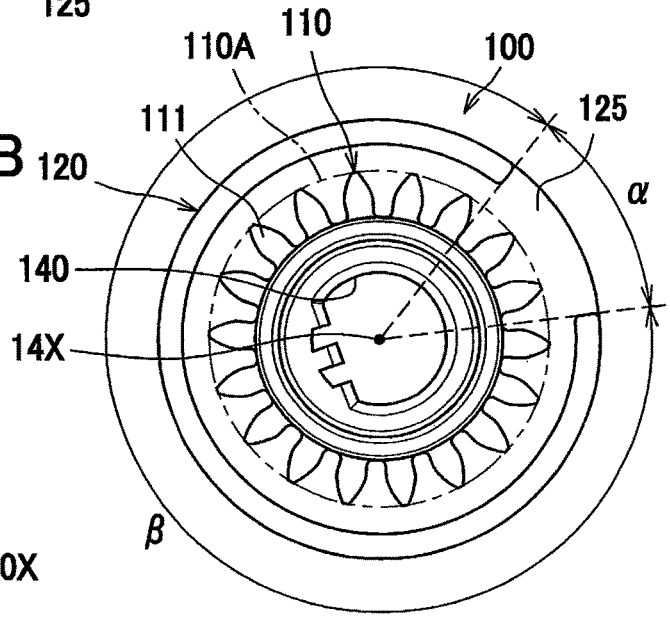
FIG. 8B is a plan view of the second agitator gear of the developing cartridge according to the embodiment as viewed in an axial direction.

As illustrated in FIGS. 8A and 8B, the second agitator gear 100 includes a first gear portion 110 and a first rib 120.

The first gear portion 110 includes a plurality of gear teeth 111. As an example, the first gear portion 110 includes the plurality of gear teeth 111 provided over the entire circumferential periphery of the second agitator gear 100.

The first rib 120 extends along an addendum circle 110A of the first gear portion 110. Specifically, the first rib 120 extends along a portion of the addendum circle 110A. Further, the first rib 120 extends along the circumferential periphery of the second agitator gear 100.

That is, the first rib 120 has a gap 125 provided along a circumferential direction of the second agitator gear 100. A second rib 230 (described later) of the detection gear 200 can be positioned within the gap 125. The gap 125 may have a central angle $\alpha$ in the range from 15 degrees to 75 degrees centered on first axis 14X. Preferably, the central angle $\alpha$ is in the range from 30 degrees to 60 degrees, and more preferably, in the range from 40 degrees to 50 degrees. Further, the first rib 120 may have a central angle $\beta$ in the range from 285 degrees to 345 degrees centered on the first axis 14X. Preferably, the central angle $\beta$ is in the range from 300 degrees to 330 degrees, and more preferably, in the range from 310 degrees to 320 degrees.

The first rib 120 is positioned farther away from the first axis 14X than the first gear portion 110 is from the first axis 14X in a radial direction of the second agitator gear 100. The first rib 120 is rotatable about the first axis 14X together with the first gear portion 110. The first rib 120 is disposed at a position offset from the first gear portion 110 in the axial direction. More specifically, the first rib 120 is positioned closer to the casing 11 than the first gear portion 110 is to the casing 11 in the axial direction (see FIG. 6).

As illustrated in FIG. 6, the detection gear 200 is positioned at the other side of the casing 11 in the first direction. That is, the detection gear 200 is positioned at the outer surface 11E. The detection gear 200 is rotatable about the second axis 200X extending in the axial direction. In a state where the detection gear 200 engages with the second agitator gear 100, the detection gear 200 is rotatable in accordance with rotation of the second agitator gear 100.

The detection gear 200 includes a cylinder portion 215 having a hole 210. As the shaft 31B of the second gear cover 31 is inserted into the hole 210, the detection gear 200 is rotatable about the shaft 31B. Here, the lid 11B of the casing 11 includes a side wall 11D which is defined at another side of the lid 11B in the first direction. The side wall 11D has a support hole 11F. The shaft 31B has a distal end portion inserted into the support hole 11F to be supported thereto.

Figure 8C:
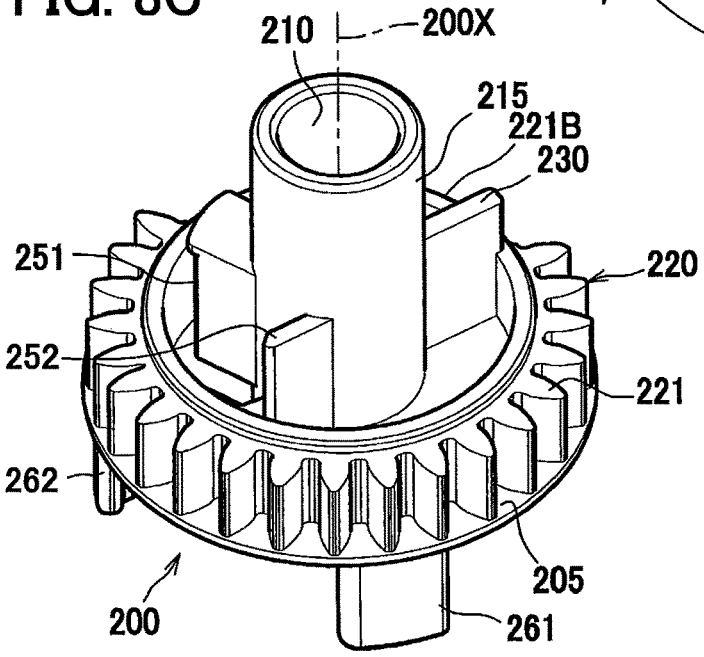
FIG. 8C is an enlarged perspective view of a detection gear of the developing cartridge according to the embodiment.

The detection gear 200 further includes a disk portion 205 extending in a direction crossing the axial direction. Preferably, the disk portion 205 extends in a direction orthogonal to the axial direction. As illustrated in FIG. 8C, the detection gear 200 also includes a second gear portion 220, the second rib 230, a first spring engagement portion 251, and a second spring engagement portion 252. The second gear portion 220, the second rib 230, the first spring engagement portion 251, and the second spring engagement portion 252 are positioned at one side of the disk portion 205 in the first direction.

The second gear portion 220 includes a plurality of gear teeth 221. The second gear portion 220 is provided at a portion of the circumferential periphery of the detection gear 200. Further, the detection gear 200 also includes a tooth-missing portion 221B positioned at a portion other than the second gear portion 220 on the circumferential periphery of the detection gear 200. The tooth-missing portion 221B is positioned at a position the same as the second gear portion 220 in the axial direction. The tooth-missing portion 221B is a portion having no gear teeth 221.

The second rib 230 has a plate shape protruding from the cylinder portion 215 in the radial direction of the detection gear 200 and protruding from the disk portion 205 in the axial direction. The second rib 230 is positioned at a position different from the second gear portion 220 in the axial direction. Specifically, the second rib 230 is positioned closer to the casing 11 than the second gear portion 220 is to the casing 11 in the axial direction. Further, the second rib 230 is positioned closer to the second axis 200X than the second gear portion 220 is to the second axis 200X in the radial direction of the detection gear 200.

Each of the first spring engagement portion 251 and the second spring engagement portion 252 protrudes radially outward from the cylinder portion 215, and protrudes from the disk portion 205 in the axial direction. Each of the first spring engagement portion 251 and the second spring engagement portion 252 has a plate shape. The first spring engagement portion 251 and the second spring engagement portion 252 are configured to engage with the torsion spring 37 of the second gear cover 31 to receive urging force from the same. The first spring engagement portion 251 and the second spring engagement portion 252 are positioned away from each other in the rotational direction of the detection gear 200 (hereinafter also simply referred to as "rotational direction").

Figure 9:
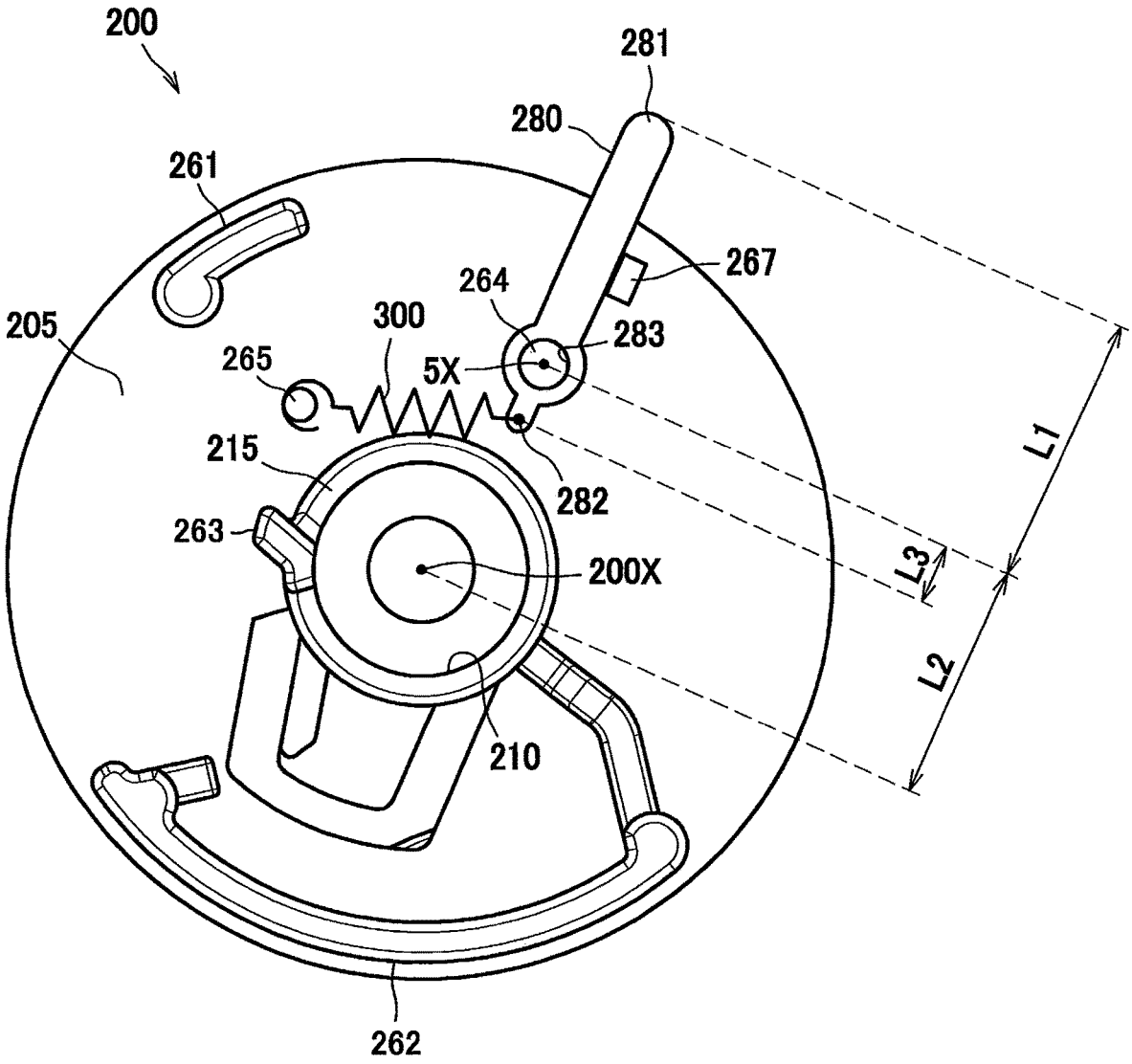
FIG. 9 is a plan view of the detection gear of the developing cartridge according to the embodiment as viewed in the axial direction.

As illustrated in FIGS. 6 and 9, the detection gear 200 further includes a first protrusion 261, a second protrusion 262, a third protrusion 263, a fourth protrusion 264, a fifth protrusion 265, and a first stopper 267. The first protrusion 261, the second protrusion 262, the third protrusion 263, the fourth protrusion 264, the fifth protrusion 265, and the first stopper 267 are positioned at another side of the disk portion 205 in the first direction. The link 280 and a spring 300 is provided at the detection gear 200. The link 280 is pivotally movable relative to the detection gear 200. The spring 300 engages with both the fifth protrusion 265 of the detection gear 200 and the link 280. The spring 300 is an example of an urging member.

The first protrusion 261 protrudes in the axial direction. More specifically, the first protrusion 261 protrudes from the disk portion 205 in the axial direction. That is, the first protrusion 261 extends in the first direction. The first protrusion 261 is movable together with the rotation of the detection gear 200. Preferably, the first protrusion 261 is rotatable together with the rotation of the detection gear 200. In other words, the detection gear 200 includes the first protrusion 261. The first protrusion 261 is integrally formed with the detection gear 200. Alternatively, the first protrusion 261 may be separately formed from the detection gear 200.

The second protrusion 262 protrudes in the axial direction and protrudes in the radial direction of the detection gear 200. More specifically, the second protrusion 262 protrudes from the disk portion 205 in the axial direction, and protrudes from the cylinder portion 215 in the radial direction of the detection gear 200. The second protrusion 262 is positioned away from both the first protrusion 261 and the link 280 in the rotational direction of the detection gear 200. The second protrusion 262 is movable together with the rotation the detection gear 200. Preferably, the second protrusion 262 is rotatable together with the rotation of the detection gear 200. That is, the detection gear 200 includes the second protrusion 262. The second protrusion 262 is integrally formed with the detection gear 200, but may be separately formed from the detection gear 200.

The third protrusion 263 protrudes from the disk portion 205 and the cylinder portion 215 in the axial direction. Further, the third protrusion 263 protrudes from the cylinder portion 215 in the radial direction of the detection gear 200. The third protrusion 263 is rotatable together with the rotation of the detection gear 200. In other words, the detection gear 200 includes the third protrusion 263. The third protrusion 263 is integrally formed with the detection gear 200.

Figure 14A:
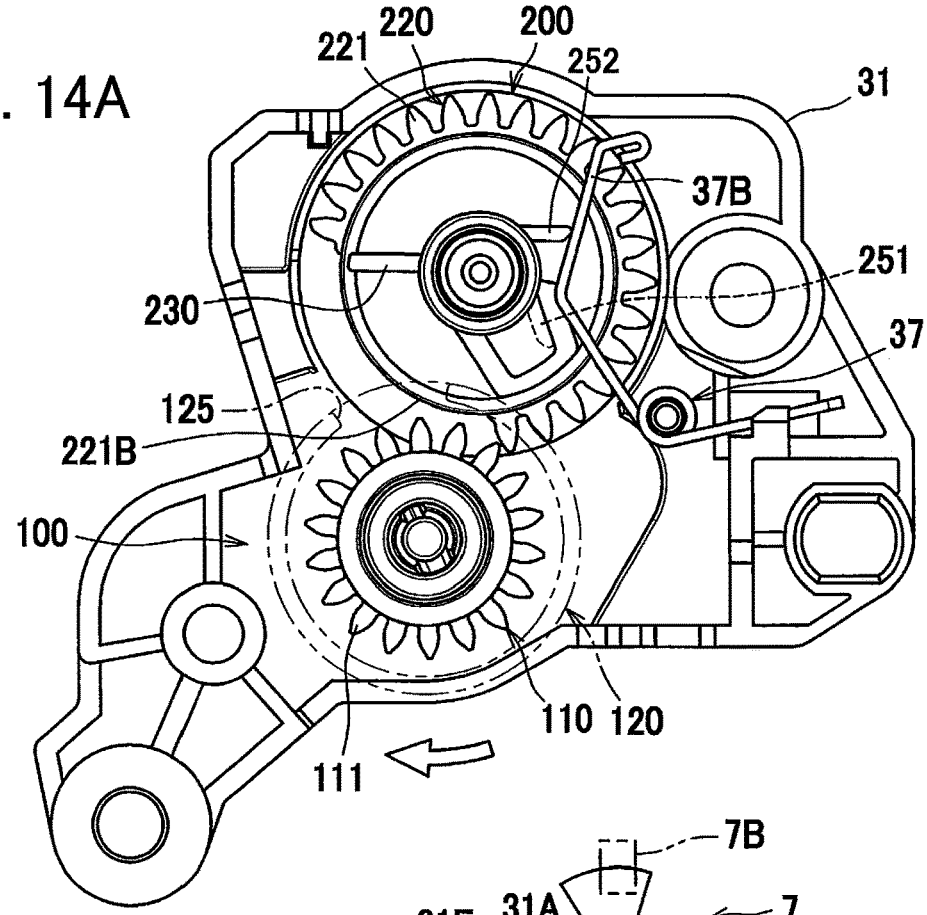
FIG. 14A is a view illustrating the second agitator gear and the detection gear of the developing cartridge according to the embodiment as viewed from the inner side of the developing cartridge, and illustrating a state where the detection gear is at its final position.
Figure 14B:
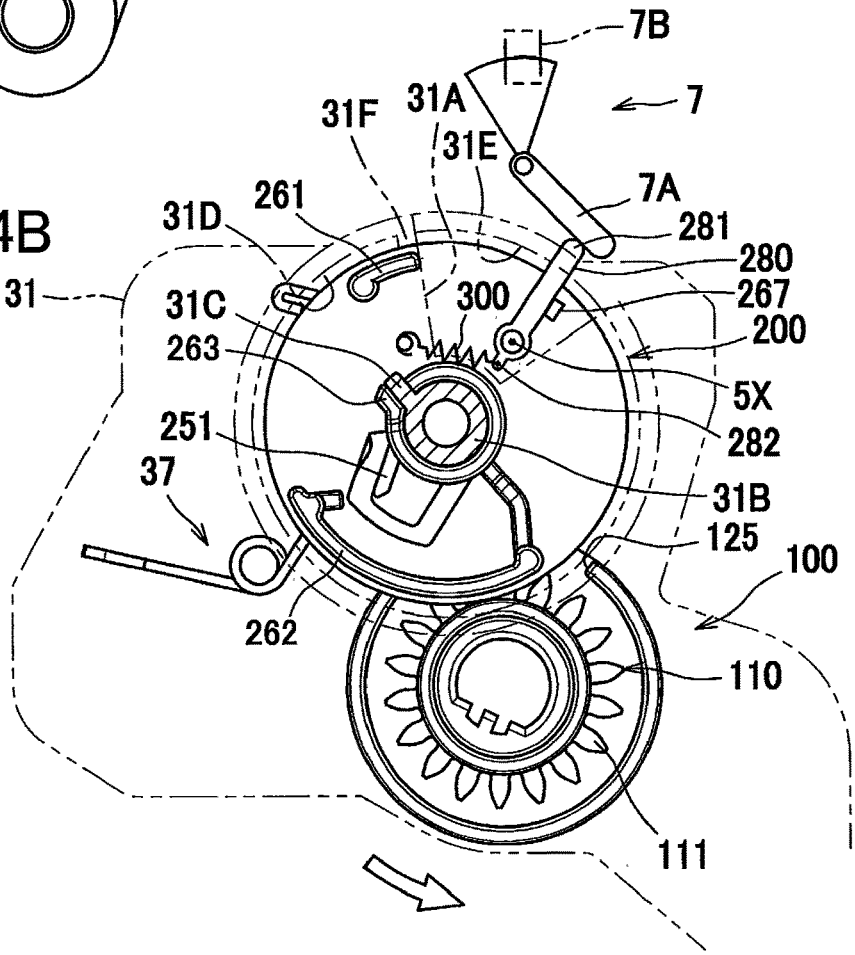
FIG. 14B is a view illustrating the second agitator gear and the detection gear of the developing cartridge according to the embodiment as viewed from the outer side of the developing cartridge, and illustrating the state where the second agitator gear is at the final position.

The third protrusion 263 is configured to engage with the protrusion 31C of the second gear cover 31 to define a posture of the detection gear 200 (see FIG. 14B).

The fourth protrusion 264 has a columnar shape protruding from the disk portion 205 in the axial direction. The fourth protrusion 264 is positioned away from and downstream of the first protrusion 261 in the rotational direction of the detection gear 200.

The fifth protrusion 265 protrudes from the disk portion 205 in the axial direction. The fifth protrusion 265 is positioned away from and upstream of the fourth protrusion 264 in the rotational direction of the detection gear 200.

The first stopper 267 protrudes from the disk portion 205 in the axial direction. The first stopper 267 is positioned downstream of the link 280 in the rotational direction of the detection gear 200. Further, the first stopper 267 is positioned further outward of the fourth protrusion 264 in the radial direction of the detection gear 200.

The link 280 is positioned away from the first protrusion 261 in the rotational direction of the detection gear 200. The link 280 is movable together with the rotation of the detection gear 200. Preferably, the link 280 is rotatable together with the detection gear 200. The link 280 has a bar-like shape. The link 280 includes the distal end portion 281 and an engagement portion 282, and has a hole 283.

The distal end portion 281 is positioned farther away from the second axis 200X than the first protrusion 261 is from the second axis 200X in the radial direction of the detection gear 200.

The hole 283 is a circular hole and formed at a position between the distal end portion 281 and the engagement portion 282. The fourth protrusion 264 is inserted into the hole 283 so as to be rotatable together with the link 280. Accordingly, the link 280 is pivotally movable about a fifth axis 5X extending in the axial direction. The fifth axis 5X passes through a diametrical center of the fourth protrusion 264 when viewed from the axial direction.

The engagement portion 282 engages with the spring 300. In the present embodiment, the engagement portion 282 is a hole. Note that the shape of the engagement portion 282 is not limited to a hole as long as the engagement portion 282 can engage with the spring 300. A distance L3 between the fifth axis 5X serving as a pivot center of the link 280 and the engagement portion 282 is smaller than a distance L1 between the fifth axis 5X and the leading end of the link 280.

The distance L1 between the fifth axis 5X and the leading end of the link 280 is greater than a distance L2 between the fifth axis 5X and the second axis 200X.

The spring 300 is a tension spring. The spring 300 has one end engaging with the engagement portion 282, and another end engaging with the fifth protrusion 265. In the present embodiment, the other end of the spring 300 has a hook shape, and is hooked to the fifth protrusion 265. As a result, the spring 300 is rotatable together with the rotation of the detection gear 200.

The first protrusion 261, the second protrusion 262, and the link 280 are provided at portions capable of contacting the lever 7A in the radial direction of the detection gear 200. The first protrusion 261, the second protrusion 262, and the link 280 are arranged in this order from the downstream side toward the upstream side in the rotational direction (i.e., the counterclockwise direction in FIG. 9). Each distal end portion of the first protrusion 261 and the second protrusion 262 has a prescribed length in the rotational direction. The length of the distal end portion of the second protrusion 262 in the rotational direction is greater than the length of the distal end portion of the first protrusion 261 in the rotational direction.

As illustrated in FIG. 8C, the second gear portion 220 is positioned between the second rib 230 and the first protrusion 261 in the axial direction.

As illustrated in FIG. 6, the torsion spring 37 includes a coil portion 37A, a first arm 37B, and a second arm 37C. The first arm 37B and the second arm 37C extend from the coil portion 37A. The second arm 37C is in contact with the second gear cover 31 and is hooked thereto.

In a state where the second rib 230 is in contact with the first rib 120, the torsion spring 37 urges the detection gear 200 in the rotational direction such that the second rib 230 is urged toward the first rib 120. More specifically, in a state where the second rib 230 is in contact with an outer peripheral surface of the first rib 120, the first arm 37B is in contact with the first spring engagement portion 251 to urge the detection gear 200 from the downstream side toward the upstream side in the rotational direction (i.e., the counterclockwise direction in FIG. 10A). Further, the torsion spring 37 is configured to engage the second gear portion 220 with the first gear portion 110 by rotating the detection gear 200 due to the urging force of the torsion spring 37 when the second rib 230 separates from the first rib 120.

Figure 10A:
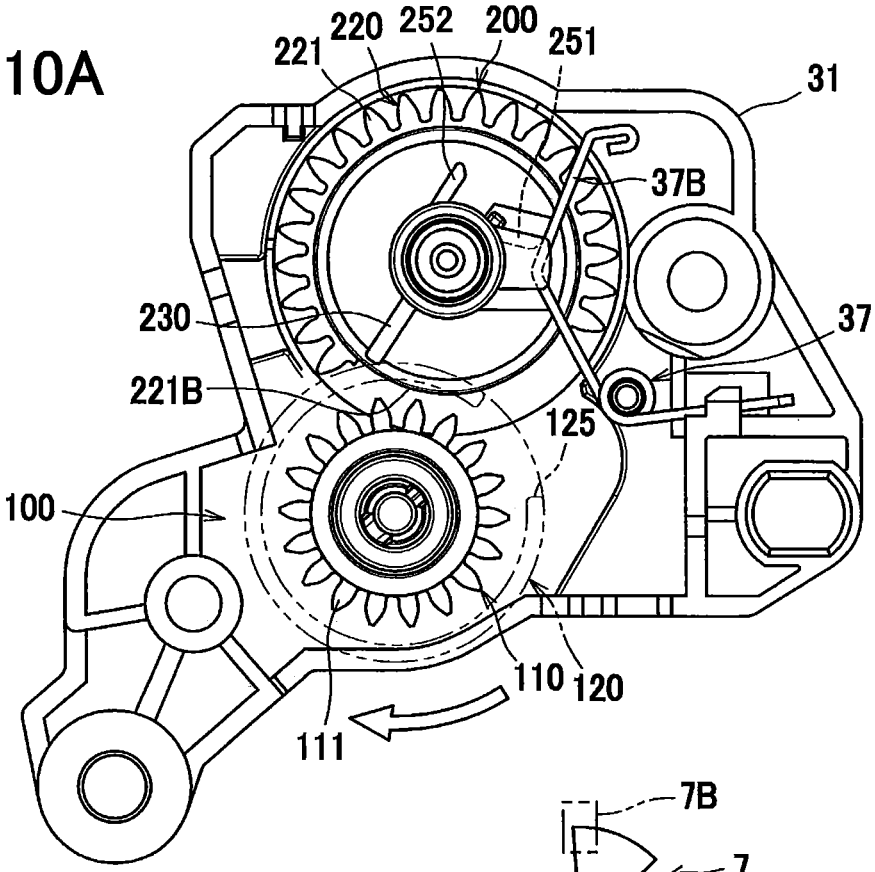
FIG. 10A is a view illustrating the second agitator gear and the detection gear of the developing cartridge according to the embodiment as viewed from an inner side of the developing cartridge, and illustrating a state where each of the second agitator gear and the detection gear is in its initial position.
Figure 10B:
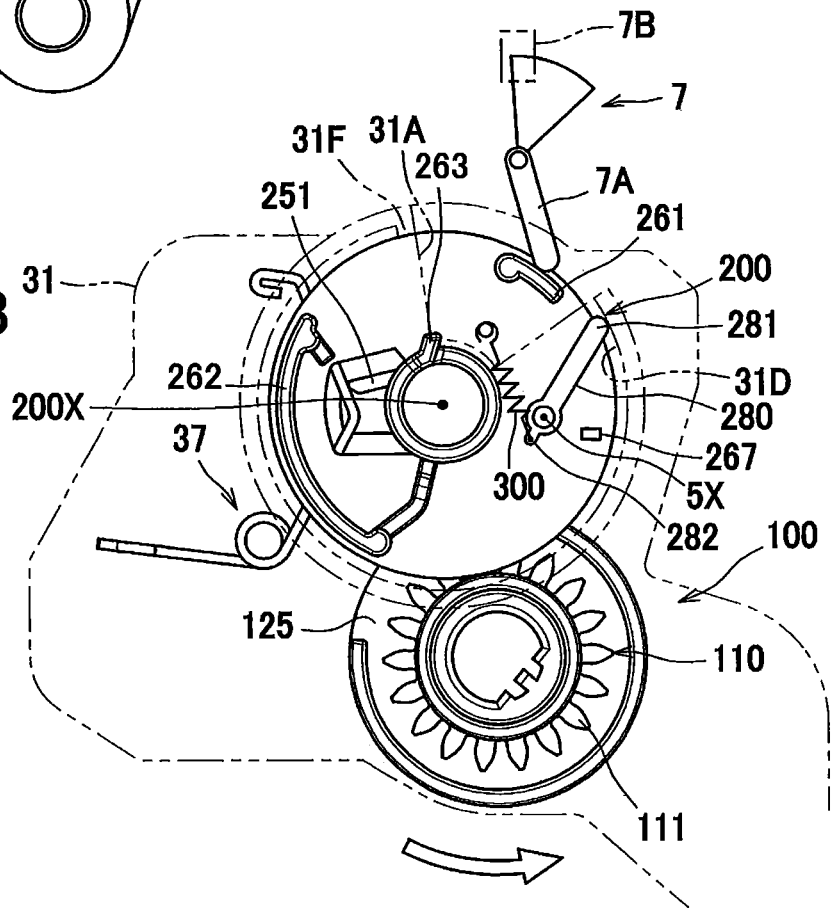
FIG. 10B is a view illustrating the second agitator gear and the detection gear of the developing cartridge according to the embodiment as viewed from an outer side of the developing cartridge, and illustrating the state where each of the second agitator gear and the detection gear is in its initial position.

In an unused state of the developing cartridge 10, the detection gear 200 is positioned at a position illustrated in FIGS. 10A and 10B relative to the second gear cover 31. Hereinafter, the position of each of the second agitator gear 100 and the detection gear 200 illustrated in FIGS. 10A and 10B will be referred to as "initial position". The initial position of the detection gear 200 is an example of a first position of the second gear. When the detection gear 200 is at the initial position, the developing cartridge 10 is in the unused state.

As illustrated in FIG. 10B, when the detection gear 200 is in the initial position, the first protrusion 261 is exposed to the outside of the second gear cover 31 through the opening 31A. Specifically, when the detection gear 200 is in the initial position in a state where the developing cartridge 10 is attached to the main body housing 2 of the laser printer 1, the distal end portion of the first protrusion 261 is in contact with the lever 7A, thereby positioning the lever 7A between the light-emitting portion and the light-receiving portion of the optical sensor 7B. Accordingly, light emitted from the light-emitting portion is blocked by the lever 7A.

Further, in a state where the detection gear 200 is positioned at the initial position, the link 280 is in a first state where the distal end portion 281 is in contact with the contact surface 31D of the second gear cover 31 due to resilient deformation of the spring 300. In this state, the distal end portion 281 is positioned upstream of the fifth axis 5X in the rotational direction, and the engagement portion 282 is positioned downstream of the fifth axis 5X in the rotational direction. The spring 300 expands toward the downstream side in the rotational direction due to a pulling force applied by the engagement portion 282. That is, the spring 300 is resiliently deformed. Note that, in the initial position of the detection gear 200, the second gear cover 31 covers at least a portion of the link 280.

The second agitator gear 100 is rotatable about the first axis 14X extending in the axial direction from a third position to a fourth position, and further from the fourth position to a fifth position. The third position is the initial position of the second agitator gear 100 that is illustrated in FIGS. 10A and 10B. The fourth position is a position illustrated in FIG. 11B where the first gear portion 110 starts to engage with the second gear portion 220. The fifth position is a position illustrated in FIGS. 14A and 14B, for example.

During rotation of the second agitator gear 100 from the third position to the fourth position, the second rib 230 is in contact with the first rib 120, and therefore the detection gear 200 does not rotate in accordance with the rotation of the second agitator gear 100. On the other hand, during rotation of the second agitator gear 100 from the fourth position to the fifth position, the second rib 230 is separated from the first rib 120, thereby allowing the detection gear 200 to rotate in accordance with the second agitator gear 100.

The detection gear 200 is rotatable from a non-engagement position to an engagement position. In the non-engagement position of the detection gear 200, none of the plurality of gear teeth 221 of the second gear portion 220 of the detection gear 200 meshingly engages with the plurality of gear teeth 111 of the first gear portion 110 of the second agitator gear 100. The non-engagement position is, for example, the initial position of the detection gear 200 illustrated in FIGS. 10A and 10B. In the engagement position of the detection gear 200, at least one gear tooth of the plurality of gear teeth 221 is in meshingly engagement with at least one gear tooth of the plurality of gear teeth 111. The engagement position is, for example, a position of the detection gear 200 illustrated in FIG. 11B.

The detection gear 200 is positioned at the non-engagement position in a state where the second rib 230 is in contact with the first rib 120, and is positioned at the engagement position in a state where the second rib 230 is separated from the first rib 120.

Figure 12A:
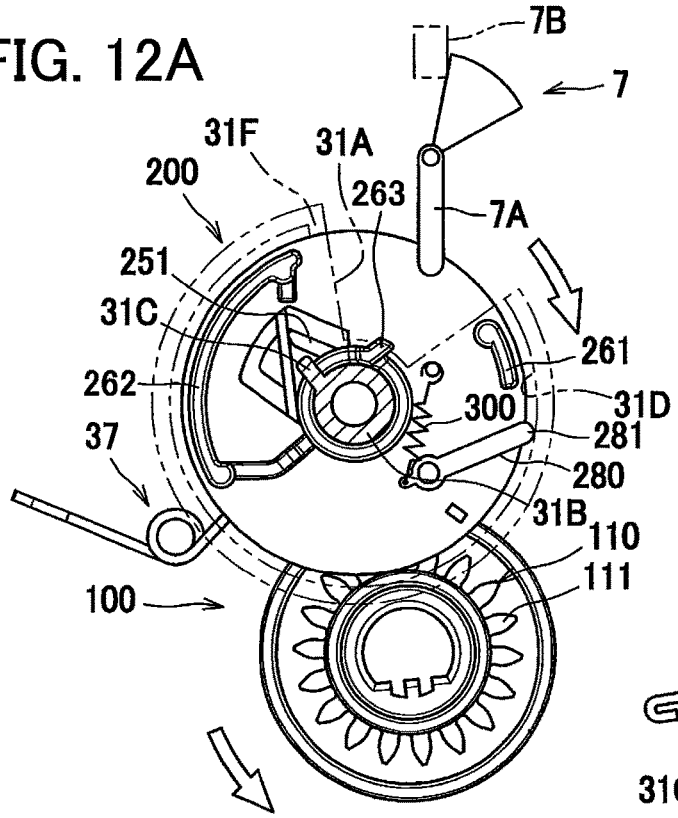
FIG. 12A is a view illustrating the second agitator gear and the detection gear of the developing cartridge according to the embodiment and a sensor of the laser printer as viewed from the outer side of the developing cartridge, and illustrating a state where a lever of the sensor is not displaced.
Figure 12B:
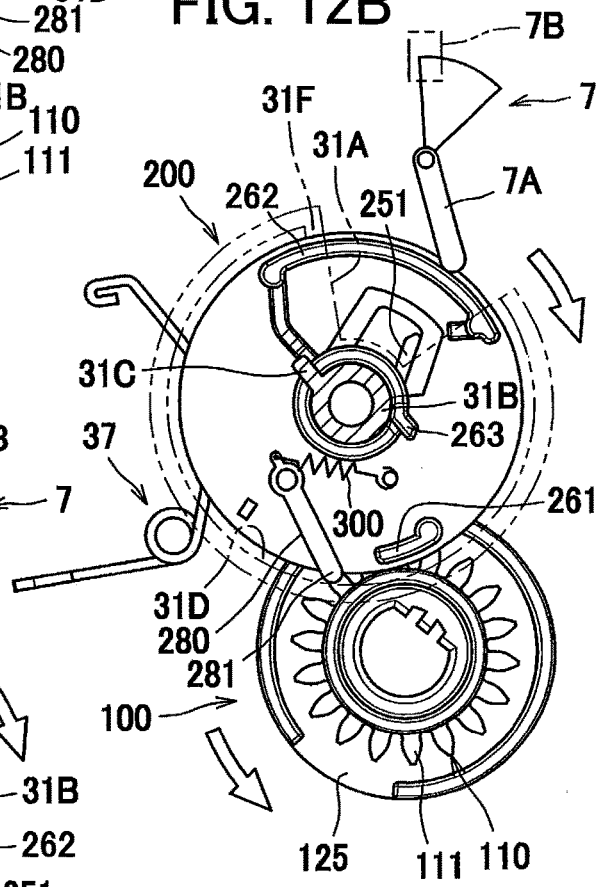
FIG. 12B is a view illustrating the second agitator gear and the detection gear of the developing cartridge according to the embodiment and the sensor of the laser printer as viewed from the outer side of the developing cartridge, and illustrating a state where a second protrusion of the detection gear is in contact with the lever and the lever is displaced.
Figure 12C:
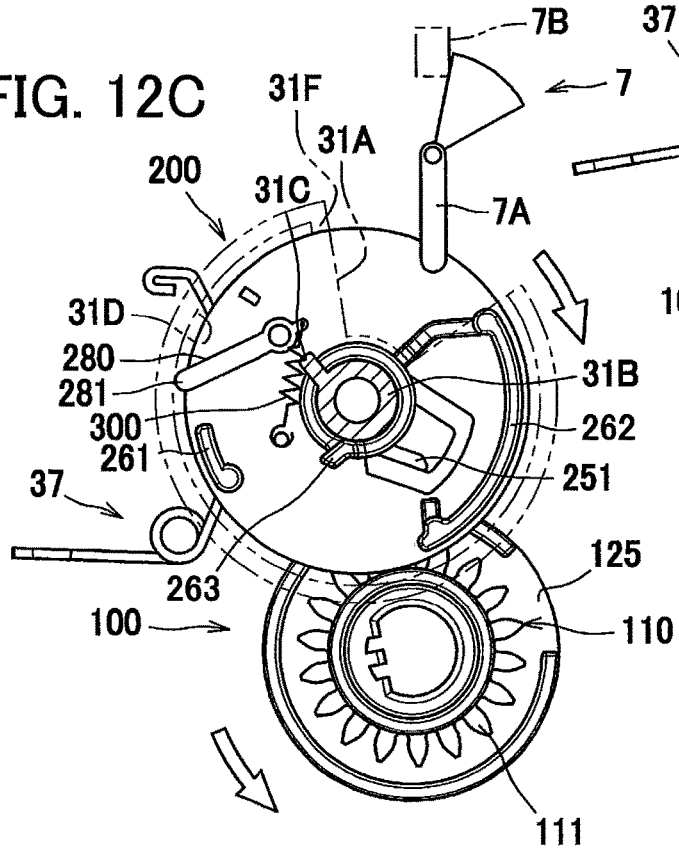
FIG. 12C is a view illustrating the second agitator gear and the detection gear of the developing cartridge according to the embodiment and the sensor of the laser printer as viewed from the outer side of the developing cartridge, and illustrating the state where the lever is not displaced.
Figure 13A:
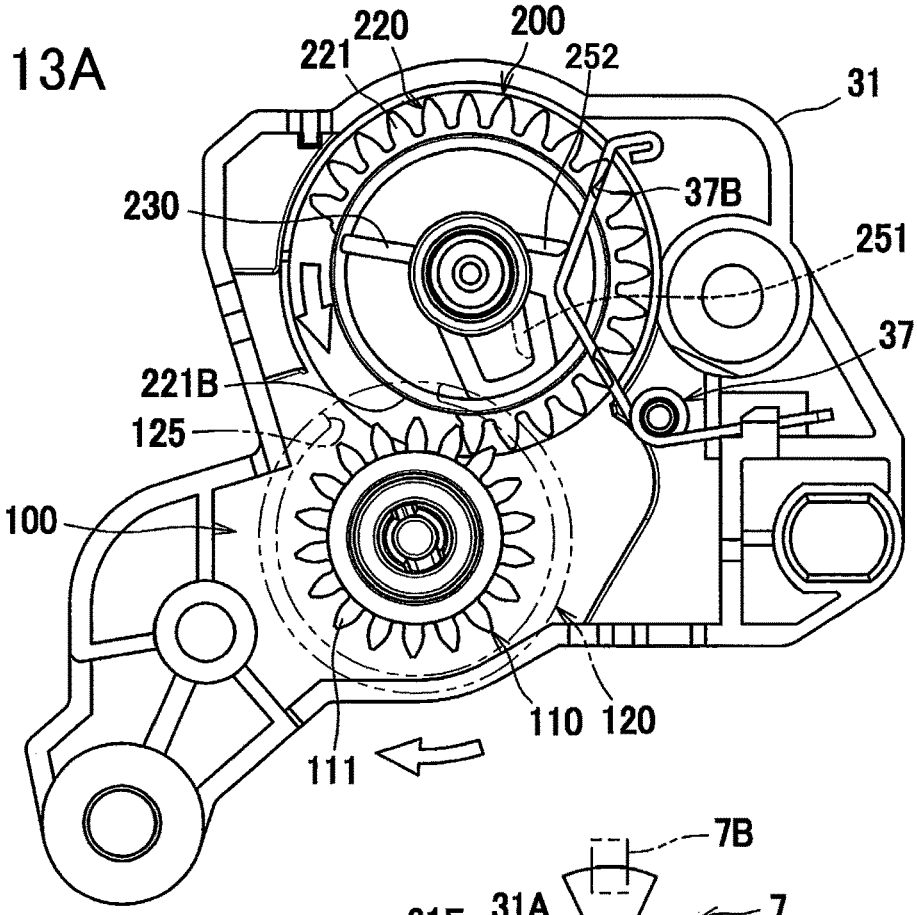
FIG. 13A is a view illustrating the second agitator gear and the detection gear of the developing cartridge according to the embodiment as viewed from the inner side of the developing cartridge, and illustrating a state at a timing when contact between a link of the detection gear and the second gear cover has been released.

The detection gear 200 rotates from its initial position to its final position illustrated in FIGS. 14A and 14B through positions illustrated in FIGS. 12A to 12C and a second position illustrated in FIG. 13A, and stops rotating. That is, the detection gear 200 is rotatable from the initial position to the final position.

In a state where the detection gear 200 is at the final position, the torsion spring 37 is in contact with the second spring engagement portion 252 so as to urge the detection gear 200 from the downstream side toward the upstream side in the rotational direction (i.e., the counterclockwise direction in FIG. 14A). Further, in the final position of the detection gear 200, the third protrusion 263 is in abutment with the protrusion 31C and is urged toward the protrusion 31C due to the urging force of the torsion spring 37, as illustrated in FIG. 14B.

When the detection gear 200 is positioned at the position illustrated in FIG. 12A, the distal end portion of the second protrusion 262 is out of contact with the lever 7A. However, when the detection gear 200 is positioned at the position illustrated in FIG. 12B, the distal end portion of the second protrusion 262 is in contact with the lever 7A. Accordingly, the lever 7A is positioned at a position between the light-emitting portion and the light-receiving portion of the optical sensor 7B, thereby blocking the light emitted from the light-emitting portion. When the detection gear 200 is positioned at the position illustrated in FIG. 12C, the distal end portion of the second protrusion 262 is not in contact with the lever 7A.

In the final position of the detection gear 200 illustrated in FIG. 14B, the link 280 is positioned at a position approximately the same as the position of the first protrusion 261 in the initial position of the detection gear 200. Specifically, when the detection gear 200 is in the final position, the distal end portion 281 of the link 280 is exposed to the outside of the second gear cover 31 through the opening 31A of the second gear cover 31.

In a state where the detection gear 200 is at its final position, the spring 300 is resiliently deformed, whereby the link 280 is in a third state in which the leading end of the link 280 is in contact with the first stopper 267. More specifically, when the detection gear 200 is at the final position, the distal end portion 281 and the engagement portion 282 of the link 280 are positioned at positions approximately the same as the fifth axis 5X in the rotational direction. That is, the first stopper 267 is positioned so that the link 280 in the third state extends in the radial direction of the detection gear 200.

Further, in the final position of the detection gear 200, the leading end of the link 280 protrudes in the radial direction of the detection gear 200 through the opening 31A. Specifically, in a state where the detection gear 200 is at the final position, the leading end of the link 280 protrudes radially outward over an extending surface 31E of the contact surface 31D in the circumferential direction of the detection gear 200.

In a state where the developing cartridge 10 is attached to the main body housing 2 of the laser printer 1 and when the detection gear 200 is in the final position, the distal end portion 281 of the link 280 is in contact with the lever 7A, and therefore the lever 7A is positioned between the light-emitting portion and the light-receiving portion. Accordingly, light emitted from the light-emitting portion is blocked by the lever 7A.

In a state where the detection gear 200 is at the position illustrated in FIG. 12A or FIG. 12C, none of the distal end portions of the first protrusion 261, the link 280, and the second protrusion 262 is not in contact with the lever 7A, and therefore the lever 7A is not positioned between the light-emitting portion and the light-receiving portion of the optical sensor 7B. Accordingly, the light emitted from the light-emitting portion can be received by the light-receiving portion without being blocked by the lever 7A.

As described above, the laser printer 1 identifies the specification of the developing cartridge 10 by making use of a detection signal obtained on the basis of changes between a state where the light-receiving portion receives light and a state where the light-receiving portion does not receive light.

Further, in the present embodiment, the distal end portion of the first protrusion 261 is in contact with the lever 7A when the detection gear 200 is positioned at the initial position, and the leading end of the link 280 is in contact with the lever 7A even when the detection gear 200 is positioned at the final position. Thus, by virtue of using the first protrusion 261 and the link 280, the laser printer 1 can determine whether or not the developing cartridge 10 is attached to the main body housing 2 of the laser printer 1.

Referring back to FIG. 6, the second bearing 34 includes a first support portion 34A and a second support portion 34B. The first support portion 34A rotatably supports the developing roller shaft 12A. The second support portion 34B rotatably supports the supply roller shaft 13A. In a state where the second bearing 34 supports the developing roller shaft 12A and the supply roller shaft 13A, the second bearing 34 is fixed to the outer surface 11E defined at the other side of the container 11A of the casing 11 in the first direction.

The developing electrode 35 is positioned at the other side of the casing 11 in the first direction and configured to supply electric power to the developing roller shaft 12A. That is, the developing electrode 35 is positioned at the outer surface 11E. For example, the developing electrode 35 is made of electrically conductive resin.

The developing electrode 35 includes a first electrical contact 35A, a second electrical contact 35B, and a connection portion 35C. The first electrical contact 35A is in contact with the developing roller shaft 12A. The connection portion 35C couples the first electrical contact 35A and the second electrical contact 35B to thereby electrically connect the first electrical contact 35A and the second electrical contact 35B.

The first electrical contact 35A has a contact hole 35E. The developing roller shaft 12A is inserted into the contact hole 35E. Preferably, the contact hole 35E is a circular hole. In a state where the developing roller shaft 12A is inserted into the contact hole 35E, the first electrical contact 35A is in contact with a portion of the developing roller shaft 12A. Specifically, in the state where the developing roller shaft 12A is inserted into the contact hole 35E, the first electrical contact 35A is in contact with the outer circumferential surface of the developing roller shaft 12A. The second electrical contact 35B of the developing electrode 35 includes a developing contact surface 35D extending in the second direction and the third direction.

The supply electrode 36 is positioned at the other side of the casing 11 in the first direction and configured to supply electric power to the supply roller shaft 13A. That is, the supply electrode 36 is positioned at the outer surface 11E. For example, the supply electrode 36 is made of electrically conductive resin.

The supply electrode 36 includes a first electrical contact 36A, a second electrical contact 36B, and a connection portion 36C. The first electrical contact 36A is in contact with the supply roller shaft 13A. The connection portion 36C couples the first electrical contact 36A and the second electrical contact 36B to thereby electrically connect the first electrical contact 36A and the second electrical contact 36B.

The first electrical contact 36A has a contact hole 36E. The supply roller shaft 13A is inserted into the contact hole 36E. Preferably, the contact hole 36E is a circular hole. In a state where the supply roller shaft 13A is inserted into the contact hole 36E, the first electrical contact 36A is in contact with a portion of the supply roller shaft 13A. Specifically, in the state where the supply roller shaft 13A is inserted into the contact hole 36E, the first electrical contact 36A is in contact with the outer circumferential surface of the supply roller shaft 13A. The second electrical contact 36B of the supply electrode 36 includes a supply contact surface 36D extending in the second direction and the third direction.

The developing electrode 35 and the supply electrode 36 are fixed, together with the second bearing 34, to the outer surface 11E defined at the other side of the casing 11 in the first direction with screws 38.

Functions and effects of the developing cartridge 10 constructed as described above will be described. For attaching the developing cartridge 10 to the main body housing 2 of the laser printer 1, the developing cartridge 10 moves toward the inside of the main body housing 2 in the third direction with the developing roller 12 being a leading end, as illustrated in FIG. 1.

In a state where the developing cartridge 10 is in the unused state illustrated in FIG. 1, i.e., the detection gear 200 is at the initial position, the distal end portion of the first protrusion 261 is exposed to the outside of the developing cartridge 10 through the opening 31A of the second gear cover 31, thereby contacting the lever 7A to displace the same. As described above, when the optical sensor 7B detects displacement of the lever 7A, the control device CU determines that the developing cartridge 10 has been attached to the main body housing 2 of the laser printer 1. Note that, in a state where the detection gear 200 is at the initial position, the link 280 does not contact the lever 7A, since the link 280 is not exposed to the outside of the developing cartridge 10 through the opening 31A.

As illustrated in FIG. 10A, the detection gear 200 in the initial position is urged in the rotational direction by the torsion spring 37. However, since movement of the second rib 230 is prevented due to contact between a leading end of the second rib 230 and the first rib 120 of the second agitator gear 100, the detection gear 200 cannot rotate. In this state, the first gear portion 110 of the second agitator gear 100 faces the tooth-missing portion 221B of the detection gear 200.

When the laser printer 1 starts to drive the drive member according to a command of the control device CU, the coupling 22 rotates, and the first agitator gear 25 also rotates through rotation of the idle gear 26, as illustrated in FIG. 4. As a result, the second agitator gear 100 positioned at the other side of the casing 11 in the first direction also rotates, since the driving power is transmitted to the second agitator gear 100 through the agitator 14.

As illustrated in FIGS. 10A and 10B, even though the second agitator gear 100 rotates in a direction indicated by an arrow, the first gear portion 110 of the second agitator gear 100 continues to face the tooth-missing portion 221B of the detection gear 200. Accordingly, rotational force of the second agitator gear 100 is not transmitted to the detection gear 200. That is, the detection gear 200 is at the non-engagement position. As the second agitator gear 100 rotates, the leading end of the second rib 230 slidingly moves on the outer peripheral surface of the first rib 120.

Figure 11A:
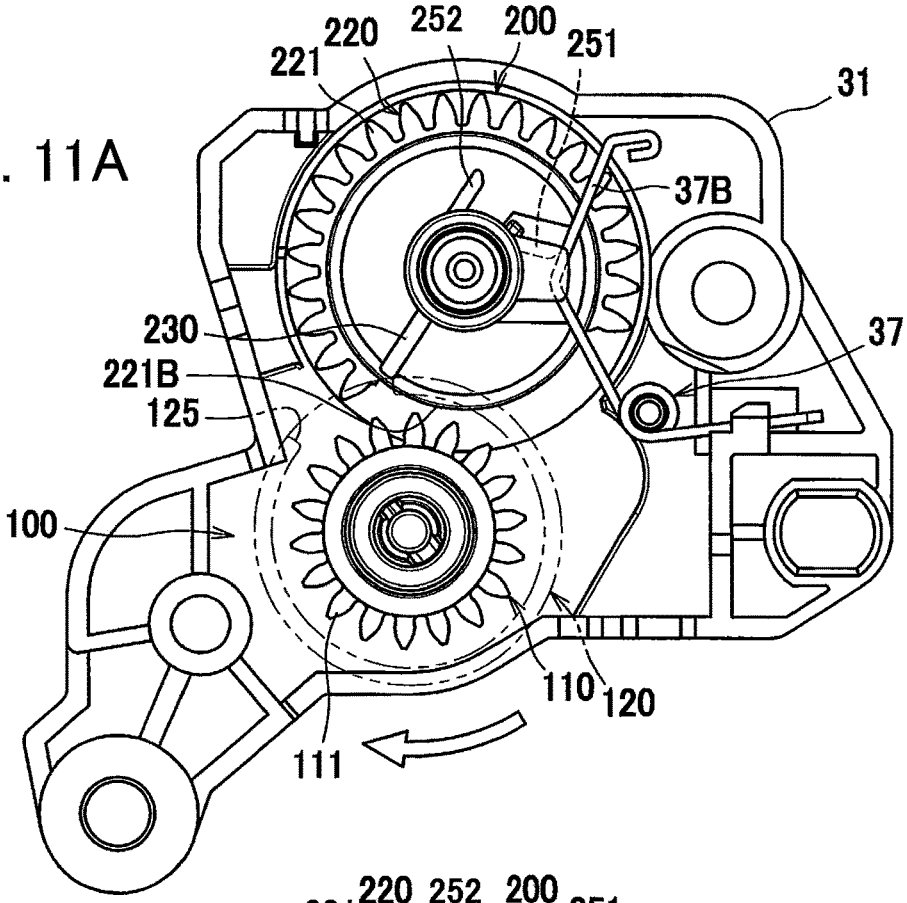
FIG. 11A is a view illustrating the second agitator gear and the detection gear of the developing cartridge according to the embodiment as viewed from the inner side of the developing cartridge, and illustrating a state immediately before a second rib of the detection gear enters a gap of a first rib of the second agitator gear.
Figure 11B:
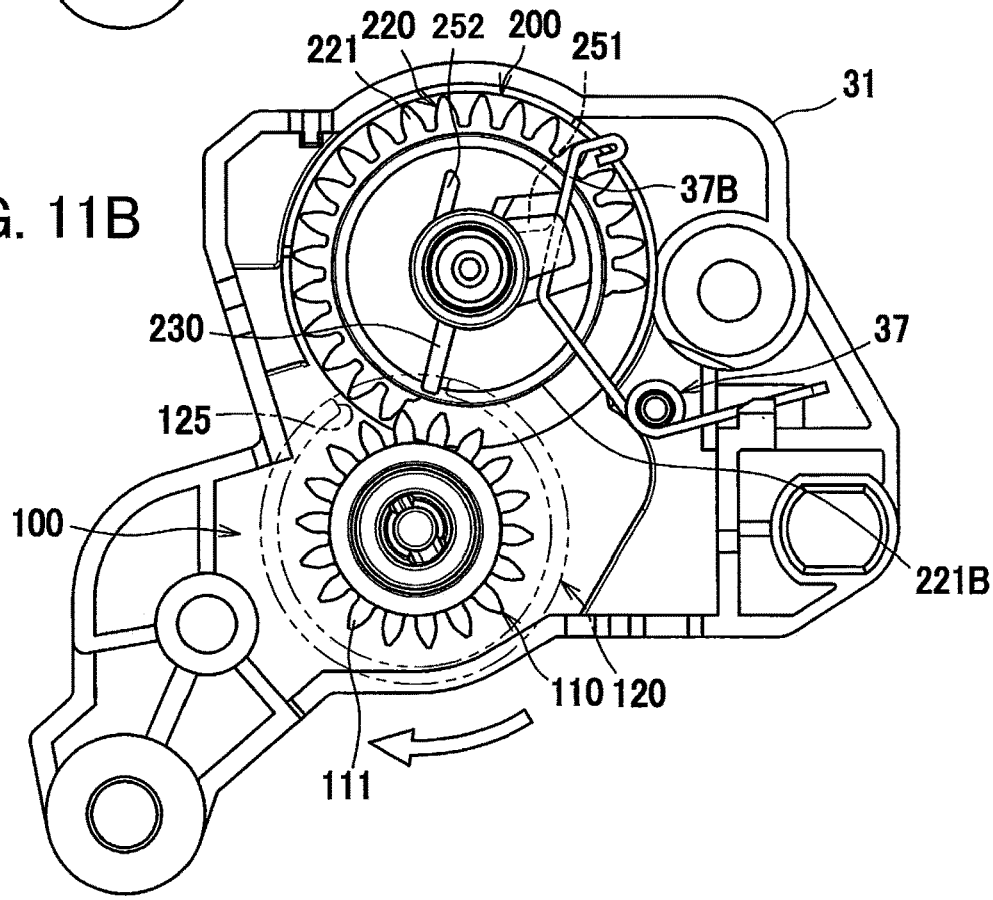
FIG. 11B is a view illustrating the second agitator gear and the detection gear of the developing cartridge according to the embodiment as viewed from the inner side of the developing cartridge, and illustrating a state where the second rib is separated from the first rib and a first gear portion of the second agitator gear starts to engages with a second gear portion of the detection gear.

As the second agitator gear 100 further rotates, the gap 125 of the first rib 120 approaches the leading end of the second rib 230 as illustrated in FIG. 11A. When the gap 125 of the first rib 120 faces the second rib 230 as illustrated in FIG. 11B, the detection gear 200 rotates in the rotational direction due to the biasing force of the torsion spring 37, whereby the leading end of the second rib 230 enters the gap 125 of the first rib 120. Accordingly, the plurality of gear teeth 221 of the second gear portion 220 engages with the plurality of gear teeth 111 of the first gear portion 110. That is, the second agitator gear 100 is positioned at the fourth position, and the detection gear 200 is positioned at the engagement position.

Upon engagement of the first gear portion 110 with the second gear portion 220, the rotational force of the second agitator gear 100 is transmitted to the detection gear 200, and the detection gear 200 is allowed to rotate in accordance with the rotation of the second agitator gear 100.

As the detection gear 200 rotates, the lever 7A is positioned between the first protrusion 261 and the second protrusion 262 as illustrated in FIG. 12A. That is, none of the first protrusion 261, the link 280, and the second protrusion 262 is in contact with the lever 7A. Accordingly, the lever 7A is not positioned between the light-emitting portion and the light-receiving portion of the optical sensor 7B, and a signal outputted from the optical sensor 7B is changed from a signal outputted in the state illustrated in FIG. 10B.

As illustrated in FIG. 12B, as the detection gear 200 further rotates, the second protrusion 262 is exposed to the outside of the developing cartridge 10 through the opening 31A and is in contact with the lever 7A. As a result, the lever 7A is positioned between the light-emitting portion and the light-receiving portion of the optical sensor 7B, thereby changing a signal outputted from the optical sensor 7B to the control device CU.

As illustrated in FIG. 12C, as the detection gear 200 still further rotates, the lever 7A is positioned between the second protrusion 262 and the link 280. In other words, all the first protrusion 261, the link 280, and the second protrusion 262 do not contact the lever 7A. In this state, the lever 7A is not positioned between the light-emitting portion and the light-receiving portion of the optical sensor 7B, and a signal outputted from the optical sensor 7B is changed from the signal outputted in the state illustrated in FIG. 12B.

As the detection gear 200 still further rotates, the distal end portion 281 of the link 280 contacts the second stopper 31F and stops moving. Then, the distal end portion 281 is pressed by the second stopper 31F and the link 280 displaces from the downstream side toward the upstream side in the rotational direction (i.e., the counterclockwise direction in FIG. 12C). At this time, the spring 300 expands and elastic energy stored in the spring 300 is increased.

Figure 13B:
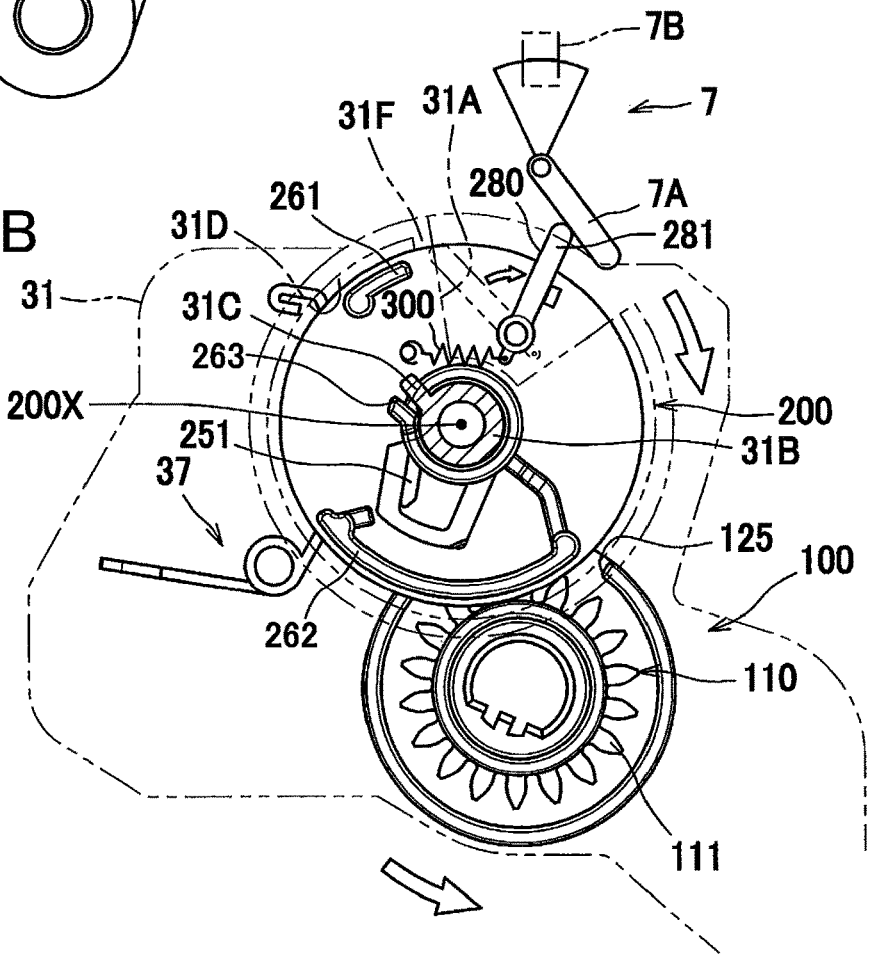
FIG. 13B is a view illustrating the second agitator gear and the detection gear of the developing cartridge according to the embodiment as viewed from the outer side of the developing cartridge, and illustrating the state at the timing when the contact between the link of the detection gear and the second gear cover has been released.

As the detection gear 200 still further rotates, the detection gear 200 is positioned at the second position illustrated in FIGS. 13A and 13B. When the detection gear 200 is at the second position, the contact between the distal end portion 281 of the link 280 and the second stopper 31F of the second gear cover 31 is released. Accordingly, the link 280 pivotally moves from the upstream side toward the downstream side of the rotational direction (i.e., the clockwise direction in FIG. 13B) relative to the detection gear 200 due to restoring force of the spring 300. At this time, the link 280 is in a second state. Subsequently, the link 280 comes to be in the third state where the link 280 is in abutment with the first stopper 267.

In a state where the detection gear 200 is at the second position, the link 280 in the third state is exposed to the outside of the second gear cover 31 through the opening 31A and is contacts with the lever 7A, thereby positioning the lever 7A between the light-emitting portion and the light-receiving portion of the optical sensor 7B. This displacement of the lever 7A causes a signal outputted from the optical sensor 7B to be changed from the signal outputted in the state illustrated in FIG. 12C.

As described above, the state in which the link 280 pivotally moves relative to the detection gear 200 will be referred to as the second state of the link 280. That is, in the second state, the link 280 pivotally moves from its first state in which the distal end portion 281 is in contact with the contact surface 31D of the second gear cover 31 toward its third state in which the link 280 is in contact with the first stopper 267.

Here, an angular velocity of the distal end portion 281 centered on the second axis 200X in the second state of the link 280 is greater than angular velocities of the first protrusion 261 and the second protrusion 262 during the rotation of the detection gear 200 illustrated in FIGS. 12A through 12C. In other words, a velocity of movement of the lever 7A when the link 280 in the second state contacts the lever 7A is greater than a velocity of movement the lever 7A in the state illustrated in FIG. 12B, i.e., when the second protrusion 262 contacts the lever 7A in accordance with the rotation of the detection gear 200.

Immediately after the link 280 contacts the lever 7A, the plurality of gear teeth 221 of the second gear portion 220 separates from the plurality of gear teeth 111 of the first gear portion 110 so that the engagement of the second gear portion 220 with the first gear portion 110 is released. Accordingly, the rotational force of the second agitator gear 100 is no longer transmitted to the detection gear 200.

At this time, however, the first arm 37B of the torsion spring 37 urges second spring engagement portion 252 of the detection gear 200 to apply a rotational force to the detection gear 200, thereby further rotating the detection gear 200 from the upstream side toward the downstream side in the rotational direction (i.e., the counterclockwise direction in FIG. 13A). As a result, the detection gear 200 is positioned at the final position illustrated in FIGS. 14A and 14B.

As illustrated in FIG. 14A. in the final position of the detection gear 200, the plurality of gear teeth 111 of the second agitator gear 100 faces the tooth-missing portion 221B of the detection gear 200. In other words, none of the plurality of gear teeth 111 is in engagement with the plurality of gear teeth 221. Further, since the orientation of the detection gear 200 (i.e., the posture of the detection gear 200) is maintained by the urging force of the torsion spring 37 and contact between the protrusion 31C and the third protrusion 263, the detection gear 200 does not rotate even when the second agitator gear 100 rotates.

In the above operation process, the output of the signal from the optical sensor 7B is switched four times after the start of the rotation of the detection gear 200. The output switching pattern (i.e., any one or any combination of: difference in length of an OFF signal or an ON signal; difference in the number of times of switching; and difference in the switching timing) can be changed by modifying at least one of the number of protrusions which rotates together with the rotation of the detection gear 200, the sizes of the protrusions in the rotational direction, and the number of the link. By correlating in advance the signal pattern with the specification of the developing cartridge 10, the control device CU can identify the specification of the developing cartridge 10.

When the used developing cartridge 10 is attached to the main body housing 2 of the laser printer 1, the detection gear 200 of the developing cartridge 10 is positioned at the final position. In this case, the link 280 is positioned at the position substantially the same as the position of the first protrusion 261 of developing cartridge 10 in the unused state. That is, the leading end of the link 280 is in contact with the lever 7A to move the lever 7A in a state where the used developing cartridge 10 is attached to the main body housing 2 of the laser printer 1. Accordingly, the control device CU can determine that the developing cartridge 10 is attached to the main body housing 2 even when the developing cartridge 10 has been already used.

Note that, when the detection gear 200 is at the final position, there is a possibility that a portion of the first protrusion 261 is exposed through the opening 31A. However, the first protrusion 261 of the detection gear 200 at the final position does not contact the lever 7A since the first protrusion 261 is positioned away from the link 280.

From the above, a developing cartridge 10 that has new gear structure used for identifying the specification of the developing cartridge 10 can be provided. More specifically, when the detection gear 200 rotates from the initial position to the second position, the contact between the distal end portion 281 and second stopper 31F of the second gear cover 31 is released, and the link 280 in the first state changes to the second state in which the link 280 pivotally moves relative to the detection gear 200 due to the restoring force of the spring 300.

With the above configuration, the link 280 can move in a manner different from the rotation of the detection gear 200. As a result, diversification of movement of the gear structure can be obtained in response to diversification of specification of the developing cartridge 10.

Further, the detection gear 200 includes the first stopper 267 that is positioned downstream of the link 280 in the rotational direction. Accordingly, excessive pivotal movement of the link 280 can be suppressed by virtue of contact of the link 280 with the first stopper 267.

The distance L1 from the fifth axis 5X to the leading end of the link 280 is greater than the distance L2 from the fifth axis 5X to the second axis 200X. That is, the fifth axis 5X which is the pivot center of the link 280 is positioned closer to the second axis 200X than to the leading end of the link 280. Accordingly, the distance from the fifth axis 5X to the leading end the link 280 can be increased. Consequently, the leading end of the link 280 can move faster.

The link 280 includes the engagement portion 282 engaging with the spring 300. Further, the distance L3 from the fifth axis 5X of the link 280 to the engagement portion 282 is smaller than the distance L1 from the fifth axis 5X to the leading end of the link 280. With these positional relationships, the leading end of the link 280 can move faster.

The second gear cover 31 includes the second stopper 31F which the distal end portion 281 of the link 280 can contact. Accordingly, when the link 280 is in the first state, the distal end portion 281 of the link 280 contacts the second stopper 31F so that the spring 300 can be sufficiently resiliently deformed.

The detection gear 200 does not rotate in accordance with the rotation of the second agitator gear 100 unless the detection gear 200 rotates from the non-engagement position to the engagement position due to the urging force of the torsion spring 37. This configuration enables the diversification of the movement of the gear structure.

The detection gear 200 does not rotate irrespective of the rotation of the second agitator gear 100, while the second rib 230 of the detection gear 200 is in contact with the first rib 120 of the second agitator gear 100. After the second agitator gear 100 rotates from the third position to the fourth position, the detection gear 200 can rotate in accordance with the rotation of the second agitator gear 100 since the second rib 230 and the first rib 120 do not contact each other. With this configuration, the movement of the gear structure can be diversified because the detection gear 200 starts rotating after a prescribed time has elapsed since the second agitator gear 100 starts rotating.

While the description has been made in detail with reference to the embodiments, it would be apparent to those skilled in the art that various modifications and variations may be made thereto without departing from the scope of the disclosure.

In the embodiment described above, the first protrusion 261 and the second protrusion 262 are rotatable together with the rotation of the detection gear 200. However, the first protrusion 261 and the second protrusion 262 may be configured so as not to be rotatable together with the rotation of the detection gear 200. For example, each of the protrusions may be a different component separately provided from the detection gear 200. In this case, the detection gear may include a cam.

Specifically, the detection gear may have such a configuration that the detection gear moves in accordance with the rotation of the coupling to transit between a first state where the cam and the protrusion contact each other and a second state where the cam and the protrusion are separated from each other, and the protrusions may move by the transition of the detection gear between the first state and the second state. For example, the protrusions may linearly move. The protrusions may have any configurations as long as the protrusions can move the lever 7A.

In the above embodiment, the first protrusion 261 is exposed to the outside of the developing cartridge 10 through the opening 31A of the second gear cover 31 and contacts the lever 7A when the detection gear 200 is at the initial position. However, the distal end portion 281 of the link 280 may be configured to be exposed through the opening 31A to contact the lever 7A in the initial position of the detection gear 200. Further, instead of the link 280, a protrusion(s) and the like may be exposed to the outside of the developing cartridge 10 through the opening 31A and may contact the lever 7A when the detection gear 200 is at the final position.

Figure 15A:
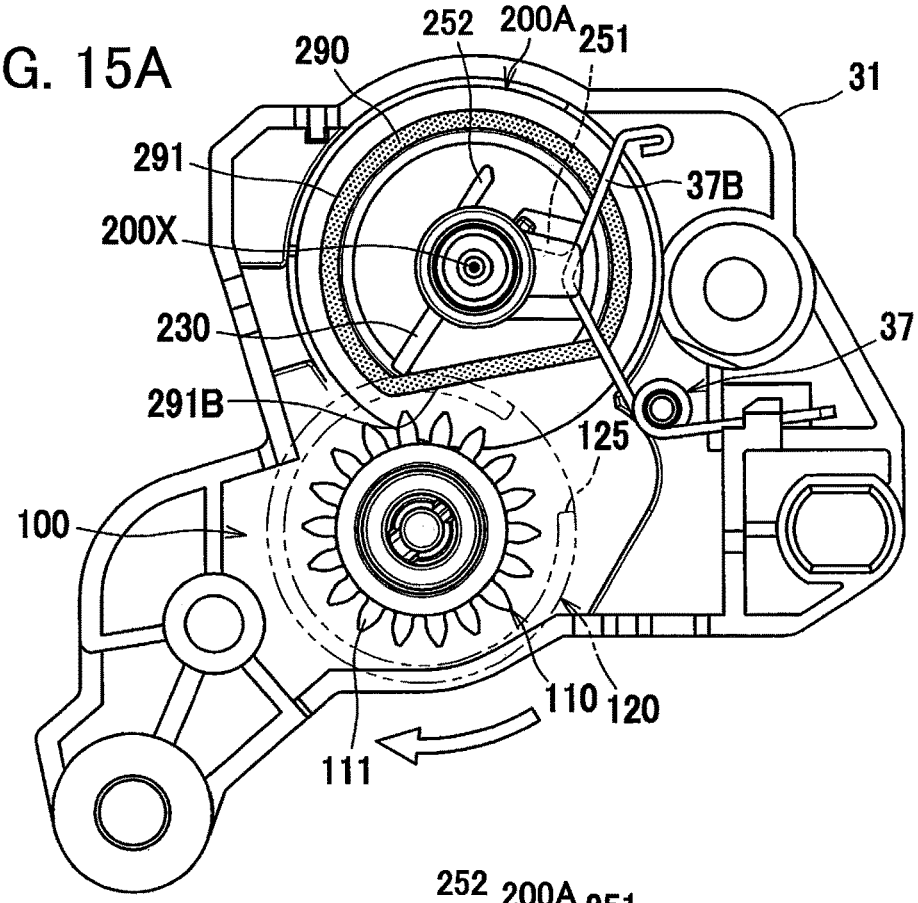
FIG. 15A is a view illustrating the second agitator gear and a detection gear of a developing cartridge according to a modification as viewed from the inner side of the developing cartridge, and illustrating a state where the detection gear is at a non-engagement position.
Figure 15B:
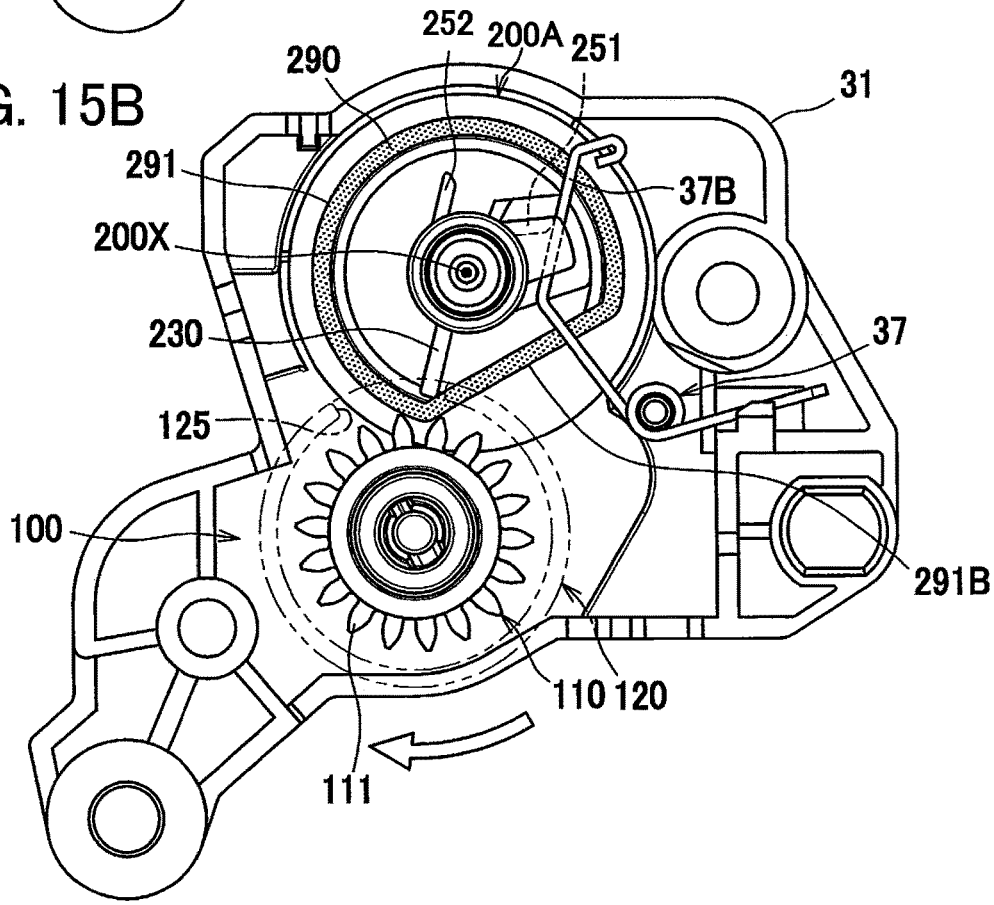
FIG. 15B is a view illustrating the second agitator gear and the detection gear of the developing cartridge according to the modification as viewed from the inner side of the developing cartridge, and illustrating a state where the detection gear is at an engagement position.

While the detection gear 200 includes the plurality of gear teeth 221 in the above-described embodiment, another configuration may be employed. For example, as illustrated in FIGS. 15A and 15B, a detection gear 200A according to a modification includes a friction member 290 instead of the plurality of gear teeth 221. The friction member 290 is provided along a circumferential periphery of the detection gear 200A.

Specifically, the friction member 290 includes an engagement portion 291 capable of engaging with the plurality of gear teeth 111 of the second agitator gear 100, and a non-engagement portion 291B that is incapable of engaging with the plurality of gear teeth 111. The engagement portion 291 is positioned farther from the second axis 200X than the non-engagement portion 291B is from the second axis 200X in a radial direction of the detection gear 200A. The friction member 290 is made of, for example, rubber.

The detection gear 200A is rotatable from a non-engagement position illustrated in FIG. 15A to an engagement position illustrated in FIG. 15B. In the non-engagement position of the detection gear 200A, since the plurality of gear teeth 111 faces the non-engagement portion 291B of the friction member 290, the engagement portion 291 of the friction member 290 does not engage with the plurality of gear teeth 111. In the engagement position of the detection gear 200A, the engagement portion 291 is in engagement with at least one gear tooth of the plurality of gear teeth 111.

When the second agitator gear 100 rotates in a state where the detection gear 200A is at the engagement position, the detection gear 200A can rotate in accordance with the rotation of the second agitator gear 100 due to frictional force provided between the plurality of gear teeth 111 and the friction member 290. With the above configuration, the detection gear 200A does not rotate in accordance with the second agitator gear 100 unless the detection gear 200A rotates from the non-engagement position to the engagement position, thereby enabling diversification of the movement the gear structure. Note that the second agitator gear 100 may also include a friction member instead of the plurality of gear teeth 111.

While the spring 300 serves as an urging member engaging with both the detection gear 200 and the link 280 in the embodiment described above, the urging member may be an elastic member such as rubber. Further, the spring is not limited to a tension spring, but may be a compression spring or a torsion spring.

Figure 16A:
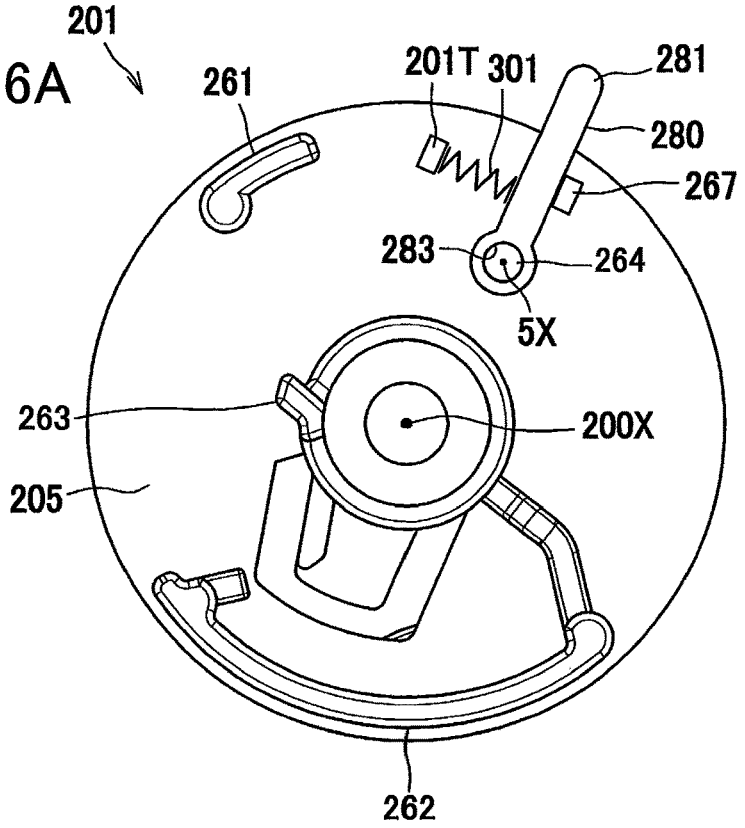
FIG. 16A is a plan view of a detection gear of a developing cartridge according to another modification in which a compression spring is employed.

As an example, a compression spring 301 is provided at a detection gear 201 illustrated in FIG. 16A. The compression spring 301 engages the detection gear 201 with the link 280. Specifically, the compression spring 301 has one end in contact with the link 280 to engage with the same, and another end engaging with a sixth protrusion 201T of the detection gear 201. Even with this configuration, the link 280 can displace from its first state to its second state due to restoring force of the compression spring 301.

Figure 16B:
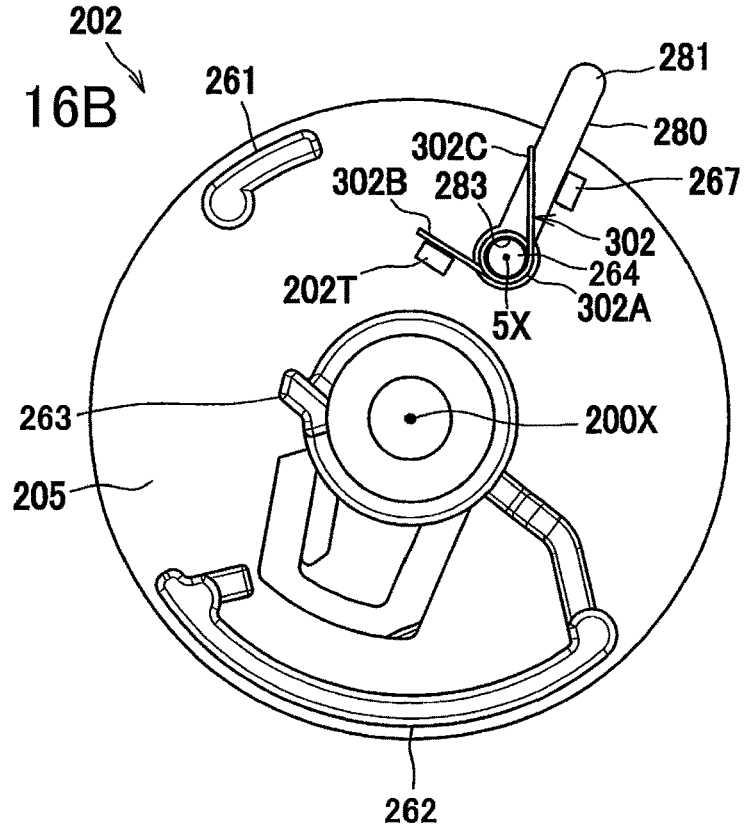
FIG. 16B is a plan view of a detection gear of a developing cartridge according to still another modification in which a torsion spring is employed.

As another example, a torsion spring 302 is provided at a detection gear 202 illustrated in FIG. 16B. The torsion spring 302 engages the detection gear 202 with the link 280. The torsion spring 302 includes a coil portion 302A, a first arm 302B, and a second arm 302C. Both the first arm 302B and the second arm 302C extend from the coil portion 302A. The coil portion 302A engages with the fourth protrusion 264. The first arm 302B is in contact with a seventh protrusion 202T of the detection gear 202 and is hooked to the seventh protrusion 202T to thereby engage with the same. The second arm 302C is in contact with the link 280 and is hooked to the link 280 to thereby engage with the same. Even in this case, the link 280 can displace from the first state to the second state due to restoring force of the torsion spring 302.

Further, while the agitator shaft 14A serves as an example of the shaft in the above embodiment, another component may be used as the shaft instead of the agitator shaft 14A. For example, a shaft may be provided and the shaft may be used only to transmit driving force from the one side to the other side of the casing 11 in the first direction.

In the above embodiment, the second agitator gear 100 serves as an example of the first gear. However, the first gear may be provided separately from the second agitator gear 100. That is, the first gear may be a gear separately provided from a gear coupled to the agitator shaft 14A. Further, all the coupling, the first gear, and the second gear may be provided at the same side of the casing 11 in the first direction.

While the initial position of the detection gear 200 serves as an example of the first position of the second gear in the above embodiment, the first position may be a position other than the initial position of the detection gear 200. Further, the position of the detection gear 200 illustrated in FIGS. 14A and 14B serves the final position of the detection gear 200 in the above embodiment, but the final position of the detection gear 200 may be a position other than the position illustrated in FIGS. 14A and 14B.

For example, both the initial position and the final position of the detection gear 200 may be the position of the detection gear 200 illustrated in FIG. 12B in which the second protrusion 262 is in contact with the lever 7A. In this case, in a state where the detection gear 200 is at the final position (i.e., in a state where the detection gear 200 is at the position illustrated in FIG. 12B), the link 280 is not exposed to the outside of the developing cartridge 10 through the opening 31A of the second gear cover 31. Consequently, this configuration can suppress the user from touching the link 280.

While the developing cartridge 10 is separately formed from the photosensitive cartridge 5, the developing cartridge 10 may be integrally formed with the photosensitive cartridge 5.

In the above-described embodiment, the monochromatic laser printer 1 is employed as an example of the image forming apparatus. However, the image forming apparatus may be a color image forming apparatus, an apparatus that performs exposure using an LED, a copying machine, or a multifunction peripheral.

The elements in the embodiment and modifications thereof may be arbitrarily combined to be implemented.

What is claimed is:

1. A developing cartridge comprising:

a casing configured to accommodate developing agent therein, the casing having an outer surface;

a first gear positioned at the outer surface, the first gear being rotatable about a first axis extending in a first direction;

a second gear positioned at the outer surface, the second gear being rotatable about a second axis extending in the first direction, the second gear being rotatable from a first position to a second position in accordance with rotation of the first gear in a state where the second gear engages with the first gear;

a cover positioned at the outer surface;

a link movable together with rotation of the second gear, the link being pivotally movable relative to the second gear, the link including a distal end portion, the link having:

a first state in which the distal end portion is in contact with the cover, the link being in the first state in a state where the second gear is at the first position; and a second state in which the distal end portion separates from the cover and the link pivotally moves relative to the second gear, the link being in the second state in a state where the second gear is at the second position; and an urging member engaging with both the second gear and the link, the urging member providing the first state of the link due to resilient deformation of the urging member, the urging member providing the second state of the link by pivotally moving the link relative to the second gear due to a restoring force of the urging member.

2. The developing cartridge according to claim 1, wherein the second gear includes a first stopper positioned downstream of the link in a rotational direction of the second gear.

3. The developing cartridge according to claim 1, wherein the link has a leading end, the leading end and a pivot center of pivotal movement of the link having a length therebetween greater than a length between the pivot center and the second axis.

4. The developing cartridge according to claim 1, wherein the link has a leading end and includes an engagement portion engaging with the urging member, the engagement portion and a pivot center of pivotal movement of the link having a length therebetween smaller than a length between the leading end and the pivot center.

5. The developing cartridge according to claim 1, wherein the cover includes a second stopper extending toward the second axis, the distal end portion being configured to contact the second stopper.

6. The developing cartridge according to claim 1, wherein the cover has an opening, wherein, in the state where the second gear is at the first position, the cover covers at least a portion of the link, and wherein, in the state where the second gear is at the second position, the distal end portion is exposed to an outside of the cover through the opening.

7. The developing cartridge according to claim 1, wherein the second gear includes a plurality of gear teeth provided at a portion of a circumferential periphery of the second gear, the second gear being rotatable from a non-engagement position to an engagement position, none of the plurality of gear teeth being in engagement with the first gear in the non-engagement position of the second gear, at least one gear tooth of the plurality of gear teeth being in engagement with the first gear in the engagement position of the second gear.

8. The developing cartridge according to claim 1, wherein the second gear includes a friction member provided at a circumferential periphery of the second gear, the second gear being rotatable from a non-engagement position to an engagement position, the friction member being not in engagement with the first gear in the non-engagement position of the second gear, the friction member being in engagement with the first gear in the engagement position of the second gear.

9. The developing cartridge according to claim 8, wherein the friction member is made of rubber.

10. The developing cartridge according to claim 1, further comprising a first protrusion extending in the first direction and positioned away from the link in a rotational direction of the second gear, the first protrusion being movable together with the rotation of the second gear.

11. The developing cartridge according to claim 10, wherein the cover has an opening, and wherein, in the state where the second gear is at the first position, the cover covers at least a portion of the link and the first protrusion is exposed to an outside of the cover through the opening.

12. The developing cartridge according to claim 10, wherein the first protrusion is rotatable together with the rotation of the second gear.

13. The developing cartridge according to claim 10, wherein the second gear includes the first protrusion.

14. The developing cartridge according to claim 10, wherein the distal end portion is positioned farther away from the second axis than the first protrusion is from the second axis in a radial direction of the second gear.

15. The developing cartridge according to claim 1, further comprising:

a coupling positioned at one side of the casing in the first direction, the coupling being rotatable about a third axis extending in the first direction; and a shaft rotatable about the first axis in accordance with rotation of the coupling, wherein the first gear is positioned at another side of the casing in the first direction, the first gear being rotatable together with the shaft.

16. The developing cartridge according to claim 15, wherein the first gear is coupled to the shaft.

17. The developing cartridge according to claim 1, further comprising a developing roller rotatable about a fourth axis extending in the first direction.

18. The developing cartridge according to claim 15, further comprising an agitator capable of agitating the developing agent, the agitator including the shaft.

19. The developing cartridge according to claim 1, wherein the urging member has one end engaging with the second gear and another end engaging with the link.

20. The developing cartridge according to claim 1, wherein the urging member is a spring.

21. The developing cartridge according to claim 1, wherein the link is pivotally movable about a pivot center.

* * * * *